US012781356B2

(12) United States Patent
Lin et al.

(10) Patent No.: US 12,781,356 B2
(45) Date of Patent: Nov. 3, 2026

(54) METHOD OF PREPARING 2-HYDROXYADPIC ACID AND ADIPIC ACID

(71) Applicant: National Cheng Kung University, Tainan City (TW)

(72) Inventors: Chia-Yu Lin, Tainan City (TW); Ting-Yi Chung, Tainan City (TW); Shih-Ching Huang, Tainan City (TW)

(73) Assignee: National Cheng Kung University, Tainan City (TW)

( * ) Notice: Subject to any disclaimer, the term of this patent is extended or adjusted under 35 U.S.C. 154(b) by 0 days.

(21) Appl. No.: 18/974,861

(22) Filed: Dec. 10, 2024

(65) Prior Publication Data

US 2025/0382711 A1 Dec. 18, 2025

(30) Foreign Application Priority Data

Jun. 14, 2024 (TW) ..... 113122130

(51) Int. Cl.

| | |
|---|---|
| ***C25B 3/07*** | (2021.01) |
| ***C25B 3/25*** | (2021.01) |
| ***C25B 11/052*** | (2021.01) |
| ***C25B 11/061*** | (2021.01) |
| ***C25B 11/065*** | (2021.01) |
| ***C25B 11/075*** | (2021.01) |
| *C23C 18/16* | (2006.01) |
| *C23C 18/31* | (2006.01) |
| *C25D 3/54* | (2006.01) |
| *C25D 5/54* | (2006.01) |

(52) U.S. Cl.

CPC ..... *C25B 3/07* (2021.01); *C25B 3/25* (2021.01); *C25B 11/052* (2021.01); *C25B 11/061* (2021.01); *C25B 11/065* (2021.01); *C25B 11/075* (2021.01); *C23C 18/1637* (2013.01); *C23C 18/31* (2013.01); *C25D 3/54* (2013.01); *C25D 5/54* (2013.01)

(58) Field of Classification Search

CPC ..... C25B 3/07; C25B 3/25
USPC ..... 205/440, 443
See application file for complete search history.

(56) References Cited

FOREIGN PATENT DOCUMENTS

WO WO-2018097725 A1 * 5/2018 ..... C25B 11/03

OTHER PUBLICATIONS

Nakagawa et al., "Reductive Conversion of Biomass-Derived Furancarboxylic Acids with Retention of Carboxylic Acid Moiety," Transactions of Tianjin University (Jun. 2021), vol. 27, No. 3, pp. 165-179. (Year: 2021).*

* cited by examiner

*Primary Examiner* — Edna Wong

(57) ABSTRACT

A method of preparing 2-hydroxyadipic acid and adipic acid is provided. The method of preparing 2-hydroxyadipic acid and adipic acid comprises a step of the electrolysis of 2,5-furandicarboxylic acid using a metal electrode at a constant current in a sulfuric acid solution containing a quaternary ammonium salt. The metal electrode is a bismuth electrode or a lead electrode. The quaternary ammonium salt is represented by formula (I):

(I)

wherein $R_1$ to $R_4$ are independently a $C_{2-5}$ hydrocarbon group, and $X^-$ is $ClO_4^-$, $H_2PO_4^-$, or $Br^-$.

7 Claims, 20 Drawing Sheets

METHOD OF PREPARING 2-HYDROXYADPIC ACID AND ADIPIC ACID

CROSS-REFERENCE TO RELATED APPLICATIONS

This application claims the benefit of priority of Taiwan Patent Application No 113122130, filed on Jun. 14, 2024, the contents of which are incorporated by reference as if fully set forth herein in their entirety.

FIELD OF INVENTION

The present disclosure relates to a method of preparing monomers of Nylon 6,6, and in particular to a method of preparing 2-hydroxyadipic acid (HAA) and adipic acid (AA).

BACKGROUND OF INVENTION

Nylon 6,6 has been widely used in the textile, plastics and automotive industries. However, monomers of nylon 6,6, namely AA and hexamethylenediamine, are produced by an energy-intensive process involving the use of high temperature/pressure conditions, non-renewable crude oil-derived feedstocks and toxic chemicals, as well as the release of environmentally-harmful chemicals. For instance, AA is synthesized from the oxidation of cyclohexane, in which cyclohexane is oxidized into cyclohexaldehyde and then into AA at high temperatures using oxygen or air as oxidant. Another example is the synthesis of AA via the oxidation of cyclohexane with addition of ammonia, in which cyclohexane is firstly oxidized to cyclohexanal, followed by reaction of cyclohexanal with ammonia to form cyclohexanoneamine and the subsequent oxidation of cyclohexanoneamine to AA. AA can also be prepared by the synthesis of hexene via the dehydrogenation of hexane, and subsequent oxidation of hexene to AA at high temperatures using oxygen or hydrogen peroxide as oxidant. AA can also be prepared by the hydrolysis of caprolactam.

The above-mentioned processes face severe challenges due to the public concerns about environmental sustainability nowadays. For example, industrial production of adipic acid has disadvantages of using KA oil derived from petrochemical crude oil as raw material, using 45 to 55% of corrosive nitric acid as an oxidant, highly exothermic reaction, and release of $N_2O$ greenhouse gas. Accordingly, it is quite important to develop efficient and environmentally friendly production processes to synthesize nylon 6,6 monomer.

SUMMARY OF INVENTION

Technical Problems

A main purpose of the present disclosure is to provide a method of preparing Nylon 6,6 monomeric precursors, 2-hydroxyadipic acid (HAA) and adipic acid (AA), with high efficiency, safety, and environment sustainability.

Technical Solutions

In order to achieve the foregoing purpose of the present disclosure, the present disclosure provides a method of preparing 2-hydroxyadipic acid and adipic acid, comprising a step of: electrolysis of 2,5-furandicarboxylic acid (2~3 mM; FDCA) using a metal electrode at a constant current in a sulfuric acid solution containing a quaternary ammonium salt (QAS), wherein the metal electrode is a bismuth electrode or a lead electrode, and the QAS is represented by formula (I):

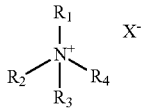

(I)

wherein $R_1$ to $R_4$ are independently a $C_{2-5}$ hydrocarbon group, and $X^-$ is $ClO_4^-$, $H_2PO_4^-$, or $Br^-$.

In one embodiment of the present disclosure, electrolysis of 2,5-furandicarboxylic acid (2~3 mM) is conducted at ambient temperature and pressure.

In one embodiment of the present disclosure, the QAS is selected from the group consisting of tetrabutylammonium phosphate (TBAP), tetrapentylammonium bromide (TPAB), tetraethylammonium perchlorate (TEAP), and tributylmethylammonium phosphate (MBAP).

In one embodiment of the present disclosure, the bismuth electrode is selected from the group consisting of an electroplated bismuth thin film-modified carbon electrode (C|Bi), a bismuth nanosheets-modified carbon electrode (C|nanoBi), and a bismuth-modified copper electrode prepared by electroless deposition (Cu|Bi).

In one embodiment of the present disclosure, a current density of the constant current ranges from −5 mA/cm$^2$ to −30 mA/cm$^2$.

In one embodiment of the present disclosure, a concentration of the quaternary ammonium salt ranges from 10 to 50 mM.

In one embodiment of the present disclosure, a concentration of the sulfuric acid ranges from 0.05 M to 1 M.

In order to achieve the foregoing purpose of the present disclosure, the present disclosure further provides a method of preparing 2-hydroxyadipic acid and adipic acid, comprising a step of: electrolysis of 2,5-furandicarboxylic acid (2~3 mM) using a bismuth electrode at a constant current in a 0.05 M to 1 M of sulfuric acid solution.

In one embodiment of the present disclosure, the bismuth electrode is an electroplated bismuth thin film-modified carbon electrode (C|Bi).

In one embodiment of the present disclosure, a current density of the constant current ranges from −5 mA/cm$^2$ to −30 mA/cm$^2$.

Beneficial Effects

Using FDCA as the reactant, a bismuth metal electrode with a specific QAS, or a bismuth metal electrode with a particular morphology without adding any QAS, enables simultaneous ring-opening and hydrogenation of 2,5-furandicarboxylic acid. This process does not require high-temperature and high-pressure conditions, precious metal catalysts, or other chemical agents. Additionally, using water as the hydrogen source eliminates the costs and energy consumption associated with hydrogen production, storage, and distribution. It also avoids competition with green hydrogen production, making this method highly applicable in green, low-carbon industrial chemical production.

DESCRIPTION OF DRAWINGS

In order to more clearly illustrate the above contents of the present disclosure, the following is a detailed description of the preferred embodiments with reference to the accompanying drawings:

(FIG. 6*a*: C|Bi; FIG. 6*b*: C|nanoBi; FIG. 6*c*: Cu|Bi) obtained during the 2-h electrolysis at −10 mA/cm$^2$ in the $H_2SO_4$ solution (0.1 M) containing FDCA (2.5 mM) and TBAP of various concentrations; (FIG. 6*h*: C|Bi; FIG. 6*i*: C|nanoBi; FIG. 6*j*: Cu|Bi) in the $H_2SO_4$ solution (0.1 M) containing FDCA (2.5 mM) and TBAP of various concentrations.

FIG. 7*a*: Potential transients; FIG. 7*b*: Faradaic efficiencies of the main products and carbon balance; FIG. 7*c*: Product selectivity; FIG. 7*d*: Product yield and FDCA conversion; FIG. 7*e*: Turnover frequency for the HAA production ($TOF_{HAA}$).

FIG. 8*a*: Potential transients; FIG. 8*b*: Faradaic efficiencies of the main products and carbon balance; FIG. 8*c*: Product selectivity; FIG. 8*d*: Product yield and FDCA conversion; FIG. 8*e*: Turnover frequency for the HAA production ($TOF_{HAA}$).

FIG. 10*a*: Potential transients; FIG. 10*b*: Faradaic efficiencies of the main products and carbon balance; FIG. 10*c*: Product selectivity; FIG. 10*d*: Product yield and FDCA conversion; FIG. 10*e*: Turnover frequency for the HAA production ($TOF_{HAA}$).

DETAILED DESCRIPTION OF PREFERRED EMBODIMENTS

Figure 1A:
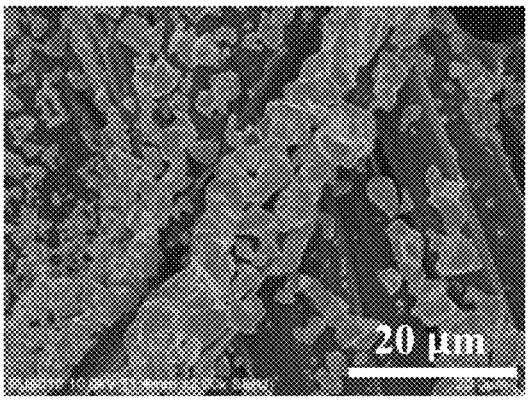
FIG. 1*a* to FIG. 1*d* are images of the surface morphology of the C|Bi electrode obtained by a scanning electron microscope (SEM).
Figure 1B:
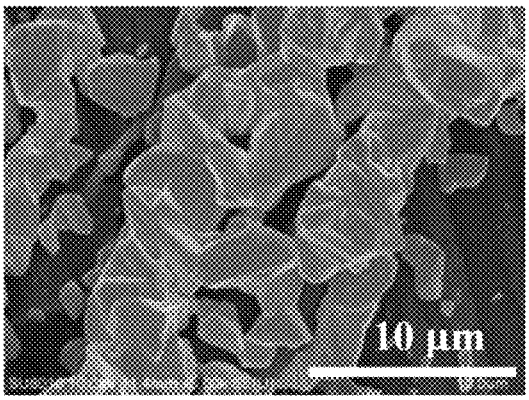
Figure 1C:
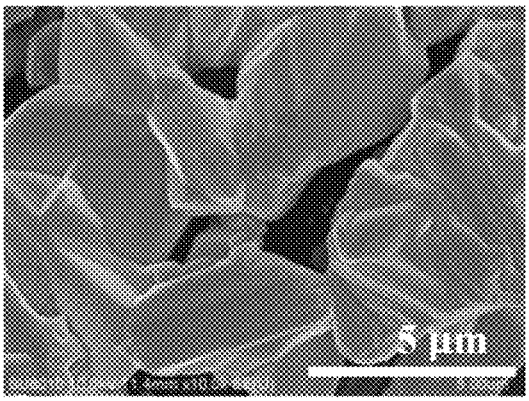
Figure 1D:
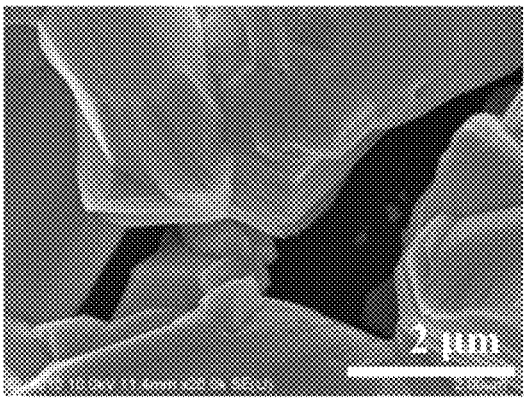
Figure 2A:
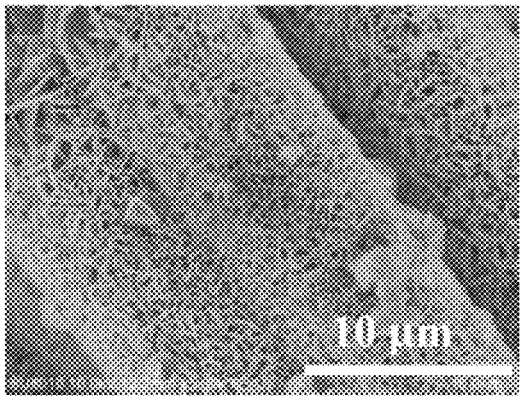
FIG. 2*a* to FIG. 2*d* are the SEM images of an electroplated BiOI nanosheets-modified carbon electrode.
Figure 2B:
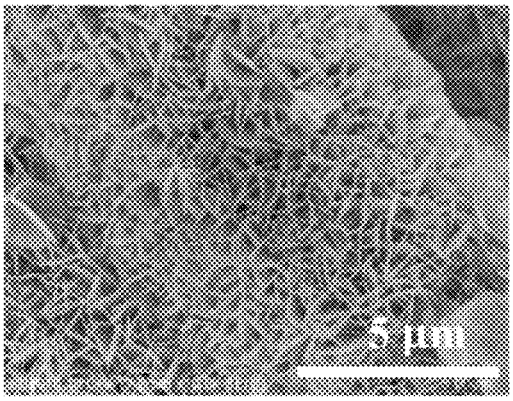
Figure 2C:
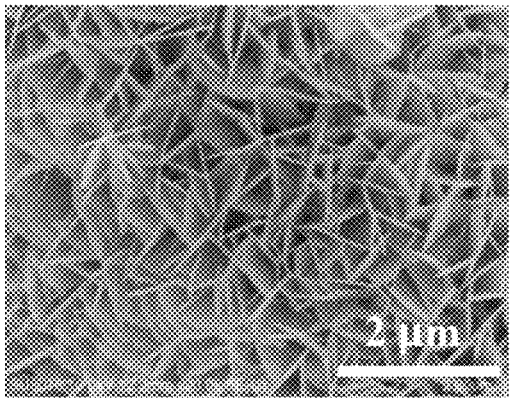
Figure 2D:
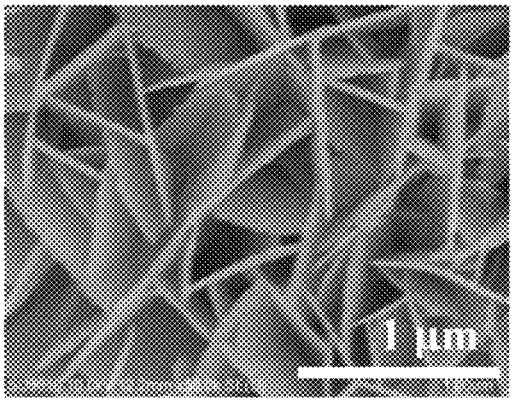

In order to describe the technical solutions of the present disclosure more clearly, numerous specific details are provided in the following specific embodiments. Apparently, the present disclosure can be practiced without certain specific details.

A method of preparing 2-hydroxyadipic acid (HAA) and adipic acid (AA) according to one embodiment of the present disclosure comprises steps of electrolyzing 2 to 3 mM (e.g., 2 mM, 2.5 mM, 3 mM) 2,5-furandicarboxylic acid (FDCA) using a bismuth electrode at a constant current in a sulfuric acid solution containing a specific quaternary ammonium salt (QAS).

The QAS is represented by the following general formula (I), wherein $R_1$ to $R_4$ are independently a $C_{2-5}$ hydrocarbon group, and $X^-$ is $ClO_4^-$, $H_2PO_4^-$, or $Br^-$.

(I)

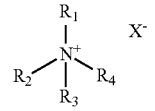

Optionally, the QAS may be selected from the group consisting of tetrabutylammonium phosphate (TBAP), tetrapentylammonium bromide (TPAB), tetraethylammonium perchlorate (TEAP), and tributylmethylammonium phosphate (MBAP). The QAS concentration may range from 10 mM to 50 mM, such as 10 mM, 15 mM, 20 mM, 25 mM, 30 mM, 35 mM, 40 mM, 45 mM, and 50 mM. The bismuth electrode is selected from the group consisting of an electroplated bismuth thin film-modified carbon electrode (C|Bi), a bismuth nanosheets-modified carbon electrode (C|nanoBi), and a bismuth-modified copper electrode prepared by electroless deposition (Cu|Bi).

In the embodiment, the applied current density for the electrolysis may range from −5 mA/cm$^2$ to −30 mA/cm$^2$, such as −5 mA/cm$^2$, −7 mA/cm$^2$, −9 mA/cm$^2$, −11 mA/cm$^2$, −13 mA/cm$^2$, −15 mA/cm$^2$, −17 mA/cm$^2$, −19 mA/cm$^2$, −21 mA/cm$^2$, −23 mA/cm$^2$, −25 mA/cm$^2$, −27 mA/cm$^2$, and −30 mA/cm$^2$. Optionally, a concentration of the sulfuric acid may range from 0.05 M to 1 M, such as 0.05 M, 0.1 M, 0.2 M, 0.3 M, 0.4 M, 0.5 M, 0.6 M, 0.7 M, 0.8 M, 0.9 M, and 1 M.

A method of preparing HAA and AA according to another embodiment of the present disclosure comprises a step of electrolyzing 2 to 3 mM (e.g., 2 mM, 2.5 mM, 3 mM) of FDCA using a bismuth electrode at a constant current density in a 0.05 M to 1 M (e.g., 0.1 M, 0.2 M, 0.3 M, 0.4 M, 0.5 M, 0.6 M, 0.7 M, 0.8 M, 0.9 M, 1 M) of sulfuric acid solution. In the embodiment, a specific type of bismuth electrode (i.e., the C|Bi electrode) can be used for the electrolysis of FDCA without the addition of a QAS, which similarly enables the ring-opening of FDCA. Optionally, the applied current density for the electrolysis may range from −5 mA/cm$^2$ to −30 mA/cm$^2$, such as −5 mA/cm$^2$, −7 mA/cm$^2$, −9 mA/cm$^2$, −11 mA/cm$^2$, −13 mA/cm$^2$, −15 mA/cm$^2$, −17 mA/cm$^2$, −19 mA/cm$^2$, −21 mA/cm$^2$, −23 mA/cm$^2$, −25 mA/cm$^2$, −27 mA/cm$^2$, and −30 mA/cm$^2$.

It is worth mentioning that the method of the present invention for preparing HAA and AA involves the electrolysis of FDCA at ambient temperature and pressure, without the need for precious metal catalysts or hydrogen gas. This process enables the ring-opening and hydrogenation of FDCA to synthesize HAA, AA, and other nylon monomers or their precursors.

As used herein and in the appended claims, singular articles such as "a" and "an" and "the" and similar referents in the context of describing the elements (especially in the context of the following claims) are to be construed to cover both the singular and the plural, unless otherwise indicated herein or clearly contradicted by context. As used herein and in the appended claims, the term "or" is to be construed to cover the term "and/or", unless otherwise indicated herein or clearly contradicted by context.

Electrode Preparation Process:

Synthesis of the C|nanoBi Electrode:

Prior to the electrode preparation, the carbon paper (Toray carbon paper) was successively cleaned with nitric acid (65%) for 5 min, ethanol (95%) for 5 min, and deionized water for 10 min under sonication. After the cleaning process, the carbon paper was dried under nitrogen purge. Then, a BiOI plating solution (pH 1.75) containing potassium iodide (0.4 M), bismuth (III) nitrate (40 mM), and 1,4-benzoquinone (50 mM) was prepared under stirring.

Electroplating and Pretreatment of the BiOI Modified Carbon Electrode:

The BiOI-modified carbon electrode was firstly prepared by the electrochemical deposition of BiOI on the cleaned carbon paper (exposed area: 1.5 cm$^2$) at a constant potential of −0.1 V vs. Ag/AgCl for 4 minutes in the BiOI plating solution. Thereafter, the obtained BiOI-modified electrode was further subjected to the electrochemical reduction process in 0.1 M borate buffer (0.1 M, pH 9.2) at a constant potential of −1.2 V vs. RHE for 30 minutes. After the reduction reaction, the electrode was taken out, rinsed with deionized water, and dried under nitrogen purge. The obtained electrode was designated as the nanoBi electrode.

Synthesis of the C|Bi Electrode:

The C|Bi electrode was prepared by the electrochemical deposition of bismuth film on the cleaned carbon paper (exposed area: 1.5 cm$^2$) at a constant current density of −5 mA/cm$^2$ for 5 minutes in the plating solution containing nitric acid (1 M) and bismuth nitrate (30 mM). After the electrochemical deposition, the electrode was taken out, rinsed with deionized water, and dried under nitrogen purge. The obtained electrode was designated as the C|Bi electrode.

Synthesis of the Cu|Bi Electrode:

Prior to the electrode preparation, a copper foil was successively cleaned with acetone for 10 min and diluted HCl aqueous solution (~1.9%) for 10 min under sonication before its usage. After the cleaning process, the copper foil was dried under nitrogen purge. A water-acetonitrile mixture (volume ratio: 1:1) containing nitric acid (1 M) and bismuth nitrate (30 mM) was prepared as reaction media for the electroless deposition. The Cu|Bi electrode was prepared by immersing the cleaned copper foil (exposed surface area: 1.5 cm$^2$) in 10 mL of the prepared reaction media for 2 minutes, and brown bismuth metal was immediately formed on the surface. The obtained Cu|Bi electrode was slowly rinsed with deionized water and dried under nitrogen purge.

Preparation of Electrolyte Solution:

The catholyte and anolyte used for electrolysis were different. The catholyte was the sulfuric acid solution (0.05 M~1.0 M) containing FDCA (2~3 mM) and specific QAS (0 to 50 mM; QAS: tetrabutylammonium phosphate (TBAP), tetrapentylammonium bromide (TPAB), tetraethylammonium perchlorate (TEAP), or tributylmethylammonium phosphate (MBAP)), whereas the anolyte was the sulfuric acid solution (2 M).

Set-Up of the Electrochemical Cell:

The electrochemical analyses were performed using an Iviumn-Stat workstation (Ivium Technologies B.V., Netherlands) connected with a well-sealed customized two-compartment H-cell. The anodic compartment and cathodic compartment of the H-cell were separated with a Nafion® 117 film. The C|Bi, C|nanoBi, or Cu|Bi electrode was used as the working electrode and placed with a Ag/AgCl reference electrode in the cathodic compartment containing catholyte solution, whereas the tantalum-iridium-titanium mesh counter electrode was placed in the anodic compartment containing anolyte solution. After placements, the cathodic compartment was sealed to facilitate subsequent analysis of gas products. The electrolysis experiments were performed at a specific constant applied current density under magnetic stirring at 1000 rpm, and the corresponding potentials were 100% iR compensated and reported against the reversible hydrogen electrode (RHE) scale. All the electrolysis were repeated 3 times to ensure the reproducibility of the results.

The C|Bi Electrode:

The electrochemical preparation of the C|Bi electrode was achieved via the electrochemical reduction of $Bi^{3+}$ to $Bi^0$ at an applied current density of +5 mA/cm$^2$ for 5 minutes. The surface morphology of the of the prepared C|Bi electrode was characterized using a scanning electron microscope (SEM). The results, shown in FIG. 1*a* to FIG. 1*d* (scale bars being 20 μm, 10 μm, 5 μm, and 2 μm, respectively), indicate that the prepared C|Bi electrode has stepped surface.

The BiOI-Modified Carbon Electrode:

SEM was used to analyze the surface morphology of the BiOI-modified carbon electrode. Refer to FIG. 2*a* to FIG. 2*d* (scale bars being 10 μm, 5 μm, 2 μm, and 1 μm, respectively). The results show hydrangea morphology formed by interlaced sheets.

Figure 3A:
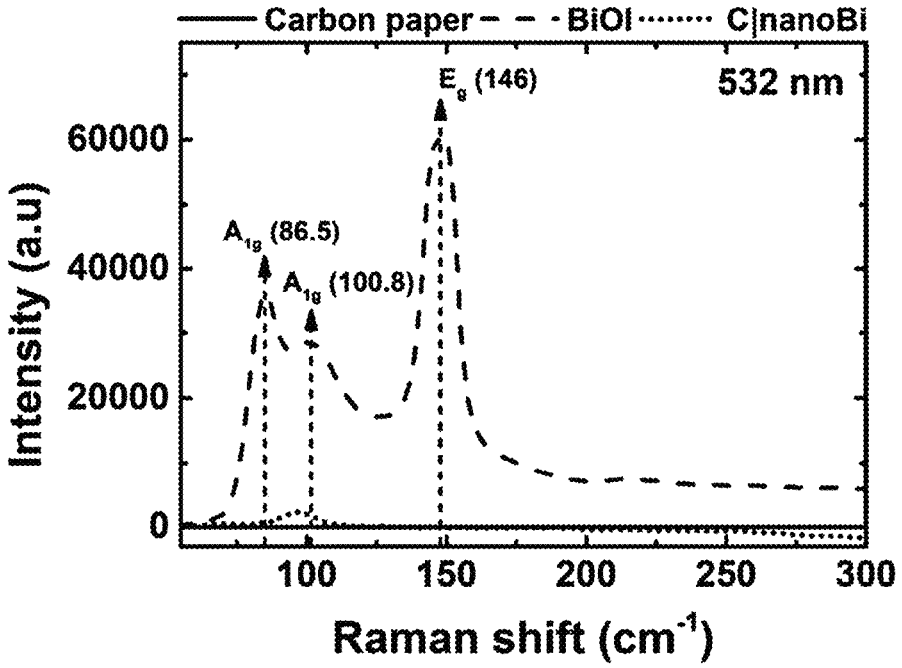
FIG. 3*a* and FIG. 3*b* are the Raman Spectra of the electroplated BiOI nanosheets-modified carbon electrode and the C|nanoBi electrode, respectively.
Figure 3B:
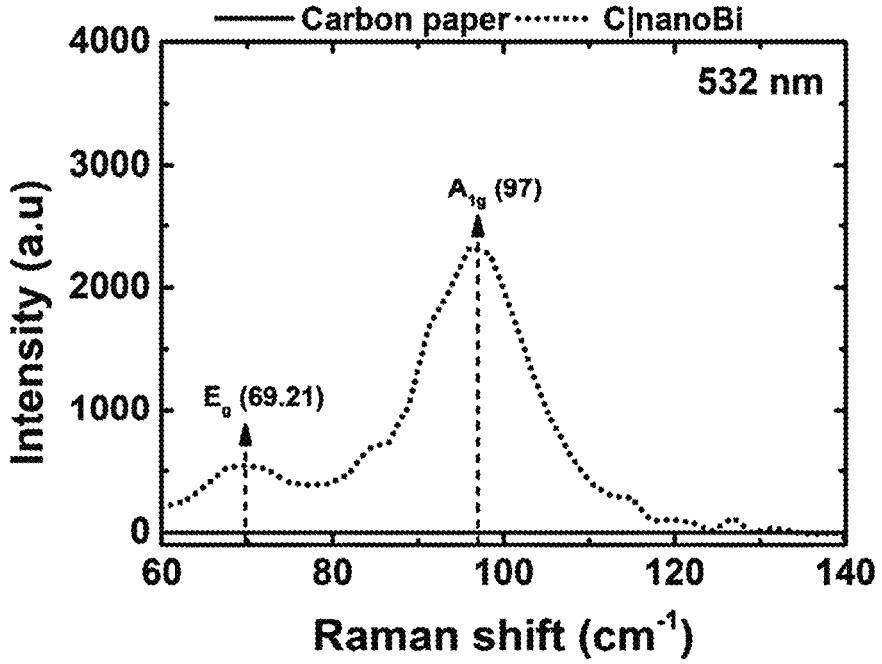
Figure 4A:
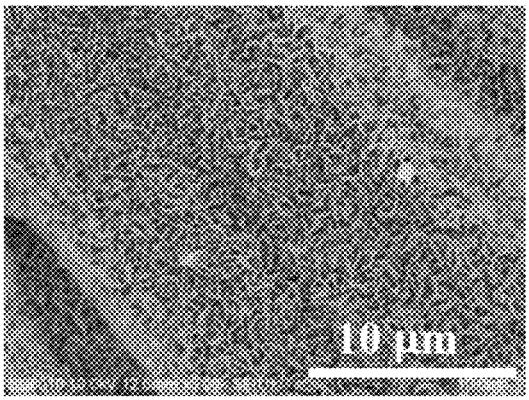
FIG. 4*a* to FIG. 4*d* are the SEM images of the C|nanoBi electrode.
Figure 4B:
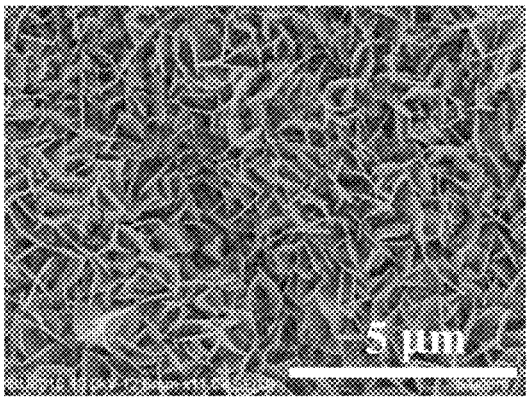
Figure 4C:
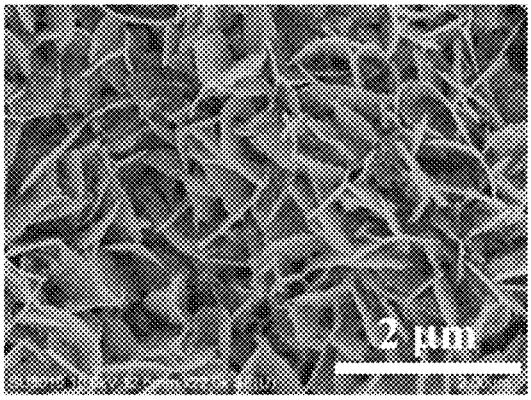
Figure 4D:
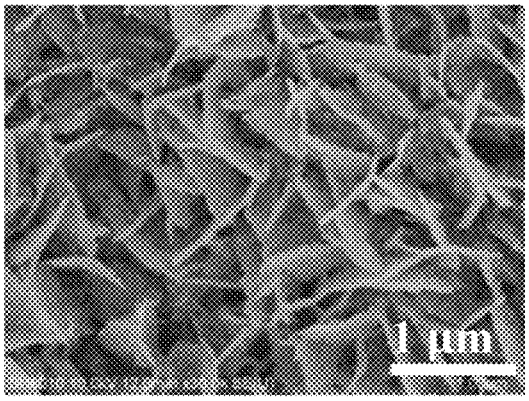
Figure 5A:
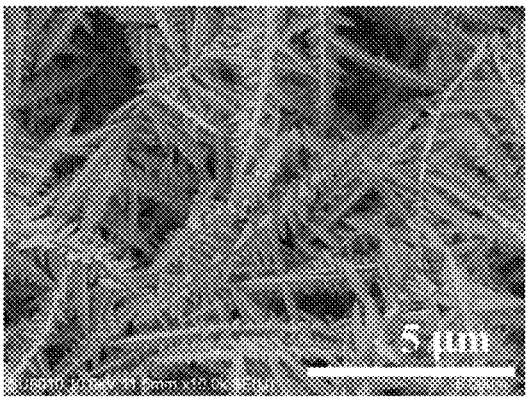
FIG. 5*a* to FIG. 5*d* are the SEM images of the Cu|Bi electrode prepared by electroless deposition.
Figure 5B:
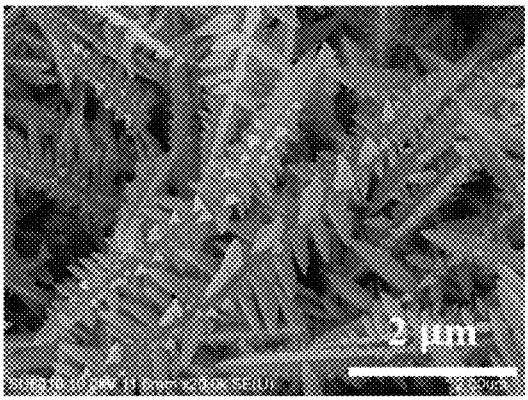
Figure 5C:
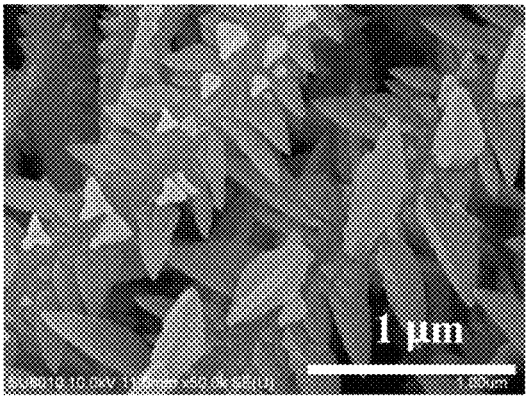
Figure 5D:
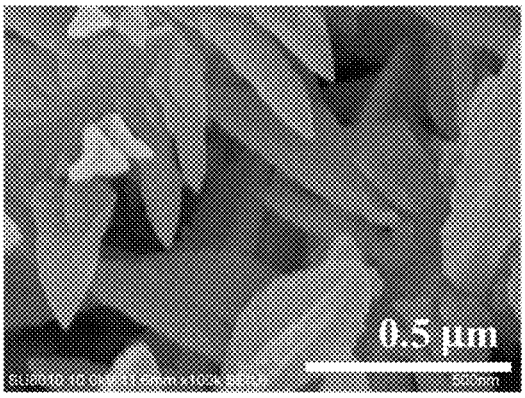

The C|nanoBi Electrode:

O and I elements of the BiOI-modified carbon electrode were completely removed by the electrochemical reduction process to obtain the C|nanoBi electrode. Raman spectrometer was used to analyze the physicochemical properties of the prepared electrodes. As revealed from FIG. 3*a* and FIG. 3*b*, the C|nanoBi electrode exhibited two characteristic peaks at 69.21 cm$^{-1}$ and 97 cm$^{-1}$ that are, respectively, responsible for the first-order $E_g$ and $A_{1g}$ stretching modes of Bi—Bi bonds. In addition, the Raman features characteristic to Bi—I bonds and Bi—O bonds (e.g., peaks at ~86.5 and ~146 cm$^{-1}$) were not observed, which suggests that the BiOI template was almost completely transformed into the metallic Bi after the electrochemical reduction process. SEM was used to analyze surface morphology of the C|nanoBi electrode. As revealed from FIG. 4*a* to FIG. 4*d* (with scale bars of 10 μm, 5 μm, 2 μm, and 1 μm, respectively), the C|nanoBi electrode has a hydrangea flower morphology similar to that of the BiOI-modified carbon electrode.

The Cu|Bi Electrode:

SEM was used to analyze surface morphology of the Cu|Bi electrode. As revealed from FIG. 5*a*-FIG. 5*d* (scale bars being 5 μm, 2 μm, 1 μm, and 0.5 μm, respectively), the prepared Cu|Bi electrode is dendrite-structured.

Effects of TBAP Concentration on the Electrocatalytic Performance of the Different Bismuth Electrodes:

The electrocatalytic performance of the above-mentioned C|Bi, C|nanoBi, and Cu|Bi electrodes towards the electrocatalytic reduction of FDCA was characterized by the 2-h electrolysis at a constant current of −10 mA/cm$^2$ in the $H_2SO_4$ solution (0.1 M) containing FDCA (2.5 mM) and TBAP of various concentrations along with the product analyses.

Figure 6A:
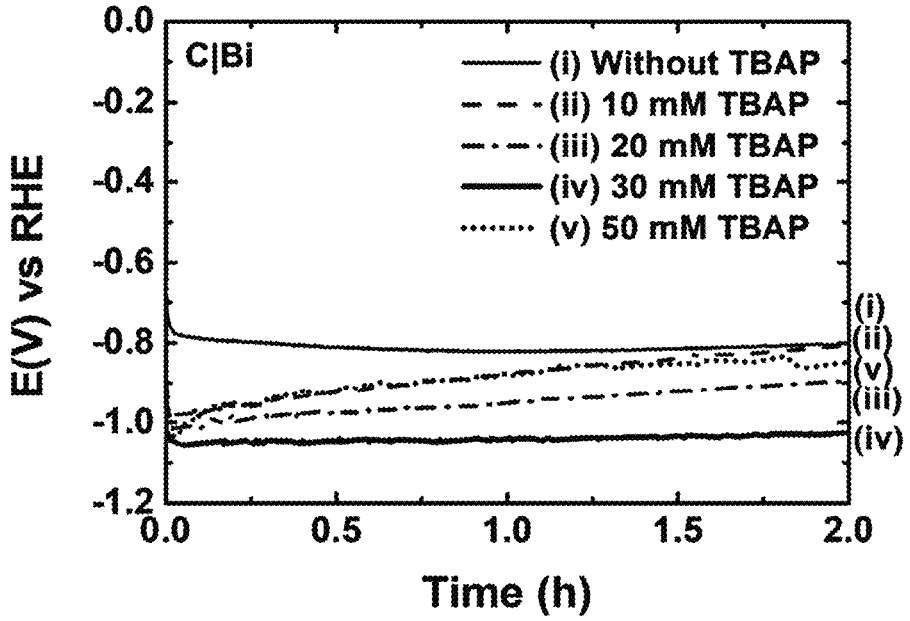
FIG. 6*a* to FIG. 6*c* show the potential transients of different bismuth electrodes
Figure 6B:
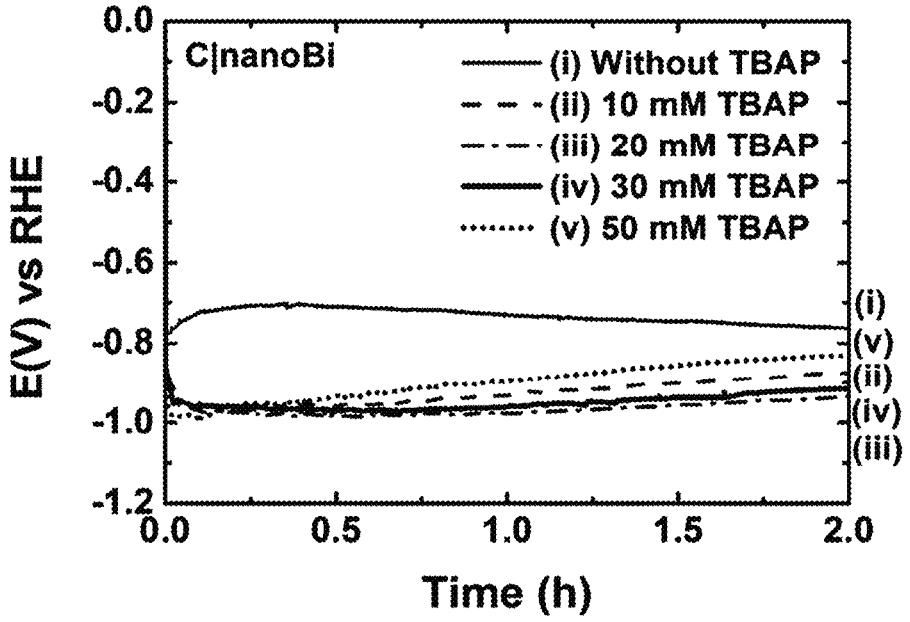
Figure 6C:
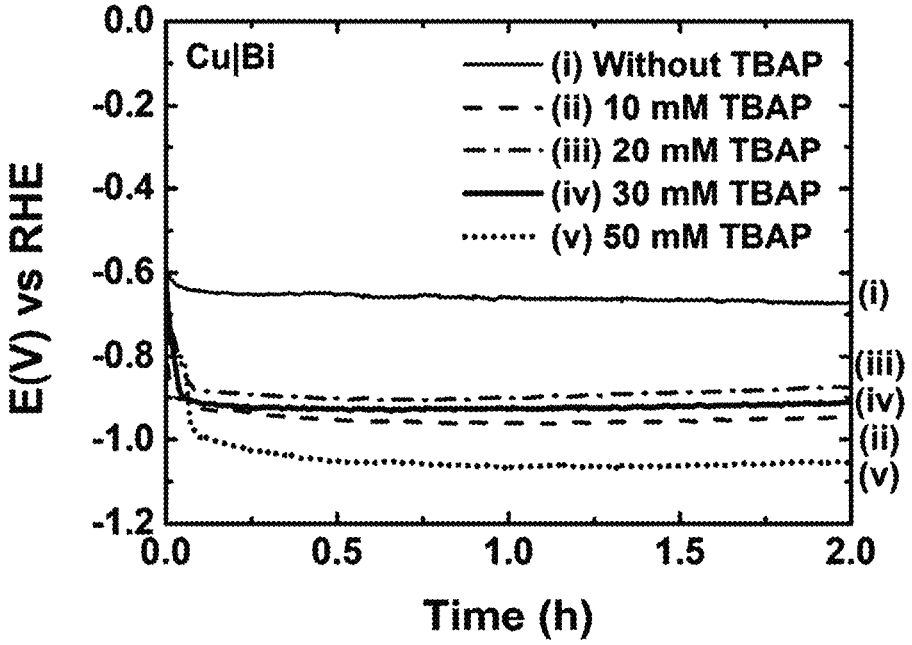

As revealed from FIG. 6*a*-FIG. 6*c* (being the C|Bi electrode, the C|nanoBi electrode, and the Cu|Bi electrode, respectively), all the electrodes required a potential of ~−0.8 V vs. RHE to maintain an applied current density of −10 mA/cm$^2$ in the absence of TBAP. In addition, the presence of TBAP increased the potential of all the electrodes to maintain an applied current density of −10 mA/cm$^2$. Nevertheless, the increase in the potential didn't correlate with the concentration of TBAP.

Figure 6D:
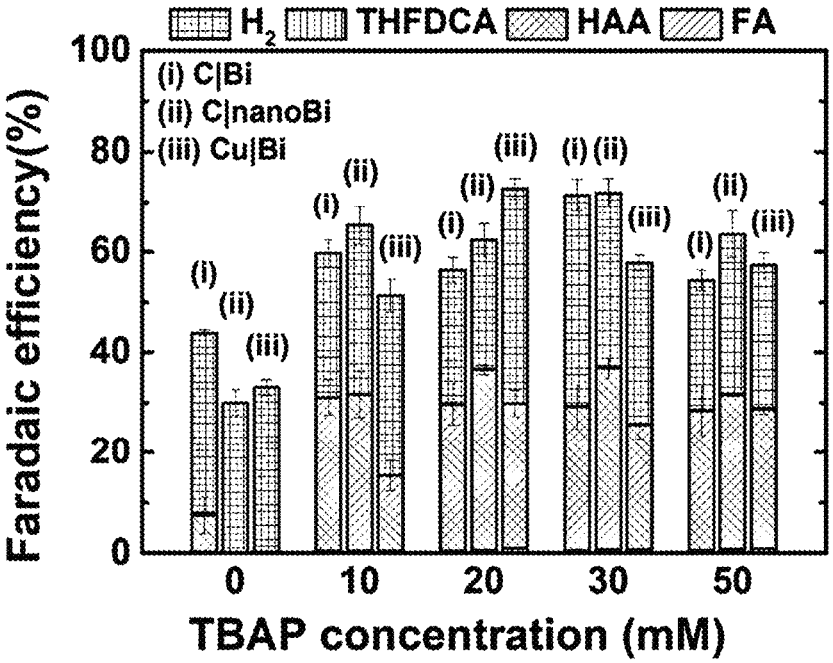
FIG. 6*d* shows the faradaic efficiency for the main products obtained from the 2-h electrolysis at −10 mA/cm$^2$ using different bismuth electrodes in the $H_2SO_4$ solution (0.1 M) containing FDCA (2.5 mM) and TBAP of various concentrations.
Figure 6E:
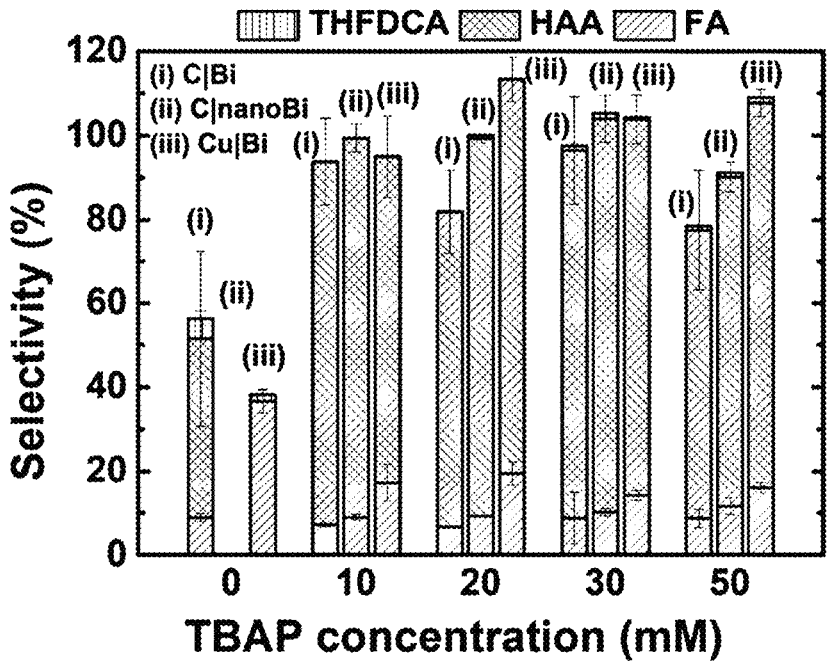
FIG. 6*e* shows the product selectivity obtained from the 2-h electrolysis at −10 mA/cm$^2$ using different bismuth electrodes in the $H_2SO_4$ solution (0.1 M) containing FDCA (2.5 mM) and TBAP of various concentrations.
Figure 6F:
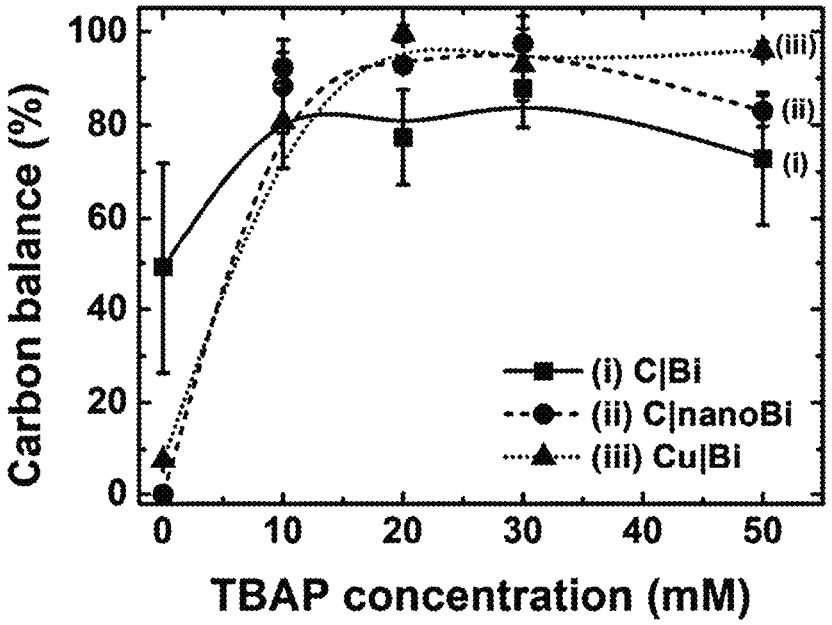
FIG. 6*f* shows the overall carbon balance, a ratio of the carbon number of the products obtained from 2-h electrolysis at −10 mA/cm$^2$ to the carbon number of FDCA initially fed for the electrolysis, for different bismuth electrodes in the $H_2SO_4$ solution (0.1 M) containing FDCA (2.5 mM) and TBAP of various concentrations.

As revealed from FIG. 6*d*-FIG. 6*f*, all the electrodes had minimal electrocatalytic performance towards the electrosynthesis of HAA via the electrochemical reduction of FDCA when the electrolysis experiments were performed in the absence of TBAP. In contrast, when the electrolysis experiments were performed in the presence of TBAP, the electrocatalytic performance of all the bismuth electrodes were significantly enhanced. Specifically, the HAA Faradaic efficiencies, HAA selectivity, and overall carbon balance of the C|Bi electrode increased from 7.24%, 42.7% and 9.08% to 30.67%, 86.56%, and 88.24%, respectively. The HAA faradaic efficiencies, HAA selectivity, and overall carbon balance of the C|nanoBi electrode increased from 0%, 0%, 0%, to 31.2%, 90.49%, and 92.26%, respectively. The HAA Faradaic efficiencies, HAA selectivity, and overall carbon balance of the Cu|Bi electrode increased from 0%, 0%, 0%, to 14.88%, 77.7%, and 80.69%, respectively. Furthermore, as revealed from TABLE 1 to TABLE 3, when the electrolysis experiments were performed in the absence of TBAP, all the bismuth electrodes showed no activity for the production of AA. However, when the electrolysis experiments were performed in the presence of TBAP (≥10 mM), the C|Bi electrode showed activity towards the generation of AA from the electrochemical reduction of FDCA. The C|nanoBi and Cu|Bi electrodes also showed activity towards the generation of AA from the electrochemical reduction of FDCA when the electrolysis experiments were performed in the presence of TBAP with concentration of ≥20 mM. These findings indicate that the inclusion of TBAP in the electrolyte for the electrolysis improves the electrocatalytic performance of the bismuth electrodes towards the electrosynthesis of HAA and AA. Note that the generation of other products, such 2-furoic acid (2-FA) and 6-hydroxycaproic acid (HCA) was also observed when the electrolysis experiments were performed in the presence of TBAP (>10 mM). The formation of HCA in the presence of TBAP could be attributed to the further hydrogenation of AA at the bismuth electrodes.

TABLE 1

Summary of the products generated from the 2-h electrolysis at −10 mA/cm$^2$ using the C|Bi electrode in $H_2SO_4$ solution (0.1M) containing FDCA (2.5 mM) and TBAP of various concentrations.

| TBAP concentration (mM) | Product | Amount of product (μmole/cm$^2$) | $FE_{Product}$ (%) | Selectivity (%) | Yield (%) |
|---|---|---|---|---|---|
| 0 | HCA | 0.00 | 0.00 | 0.00 | 0.00 |
| | 2-FA | 0.01 | 0.00 | 0.05 | 0.02 |
| | AA | 0.00 | 0.00 | 0.00 | 0.00 |
| 10 | HCA | 0.18 | 0.24 | 0.41 | 0.31 |
| | 2-FA | 0.02 | 0.00 | 0.04 | 0.03 |
| | AA | 0.01 | 0.02 | 0.03 | 0.02 |
| 20 | HCA | 0.31 | 0.42 | 0.65 | 0.52 |
| | 2-FA | 0.02 | 0.00 | 0.04 | 0.03 |
| | AA | 0.03 | 0.03 | 0.06 | 0.05 |
| 30 | HCA | 0.60 | 0.80 | 1.42 | 1.02 |
| | 2-FA | 0.02 | 0.00 | 0.05 | 0.04 |
| | AA | 0.06 | 0.06 | 0.13 | 0.10 |
| 50 | HCA | 0.65 | 0.87 | 1.28 | 1.10 |
| | 2-FA | 0.04 | 0.01 | 0.08 | 0.07 |
| | AA | 0.05 | 0.06 | 0.10 | 0.09 |

TABLE 2

Summary of the products generated from the 2-h electrolysis at −10 mA/cm$^2$ using the C|nanoBi electrode in $H_2SO_4$ solution (0.1M) containing FDCA (2.5 mM) and TBAP of various concentrations.

| TBAP concentration (mM) | Product | Amount of product (μmole/cm$^2$) | $FE_{Product}$ (%) | Selectivity (%) | Yield (%) |
|---|---|---|---|---|---|
| 0 | HCA | 0.00 | 0.00 | 0.00 | 0.00 |
| | 2-FA | 0.00 | 0.00 | 0.00 | 0.00 |
| | AA | 0.00 | 0.00 | 0.00 | 0.00 |
| 10 | HCA | 0.11 | 0.15 | 0.26 | 0.18 |
| | 2-FA | 0.01 | 0.00 | 0.03 | 0.02 |
| | AA | 0.00 | 0.00 | 0.00 | 0.00 |
| 20 | HCA | 0.17 | 0.23 | 0.34 | 0.28 |
| | 2-FA | 0.03 | 0.00 | 0.06 | 0.05 |
| | AA | 0.05 | 0.06 | 0.10 | 0.08 |
| 30 | HCA | 0.22 | 0.30 | 0.46 | 0.37 |
| | 2-FA | 0.02 | 0.00 | 0.04 | 0.03 |
| | AA | 0.07 | 0.07 | 0.14 | 0.11 |
| 50 | HCA | 0.55 | 0.74 | 1.12 | 0.94 |
| | 2-FA | 0.05 | 0.01 | 0.11 | 0.09 |
| | AA | 0.07 | 0.07 | 0.13 | 0.11 |

TABLE 3

Summary of the products generated from the 2-h electrolysis at −10 mA/cm$^2$ using the Cu|Bi electrode in $H_2SO_4$ solution (0.1M) containing FDCA (2.5 mM) and TBAP of various concentrations.

| TBAP concentration (mM) | Product | Amount of product (μmole/cm$^2$) | $FE_{Product}$ (%) | Selectivity (%) | Yield (%) |
|---|---|---|---|---|---|
| 0 | HCA | 0.00 | 0.00 | 0.00 | 0.00 |
| | 2-FA | 0.00 | 0.00 | 0.00 | 0.00 |
| | AA | 0.00 | 0.00 | 0.00 | 0.00 |
| 10 | HCA | 0.02 | 0.02 | 0.06 | 0.03 |
| | 2-FA | 0.01 | 0.00 | 0.05 | 0.02 |
| | AA | 0.00 | 0.00 | 0.00 | 0.00 |
| 20 | HCA | 0.20 | 0.26 | 0.51 | 0.32 |
| | 2-FA | 0.03 | 0.00 | 0.07 | 0.05 |
| | AA | 0.04 | 0.04 | 0.10 | 0.06 |
| 30 | HCA | 0.06 | 0.08 | 0.18 | 0.10 |
| | 2-FA | 0.01 | 0.00 | 0.04 | 0.02 |
| | AA | 0.04 | 0.04 | 0.12 | 0.07 |

TABLE 3-continued

Summary of the products generated from the 2-h electrolysis at −10 mA/cm$^2$ using the Cu|Bi electrode in $H_2SO_4$ solution (0.1M) containing FDCA (2.5 mM) and TBAP of various concentrations.

| TBAP concentration (mM) | Product | Amount of product (μmole/cm$^2$) | $FE_{Product}$ (%) | Selectivity (%) | Yield (%) |
|---|---|---|---|---|---|
| 50 | HCA | 0.01 | 0.02 | 0.03 | 0.02 |
| | 2-FA | 0.01 | 0.00 | 0.02 | 0.02 |
| | AA | 0.08 | 0.09 | 0.22 | 0.14 |

Figure 6G:
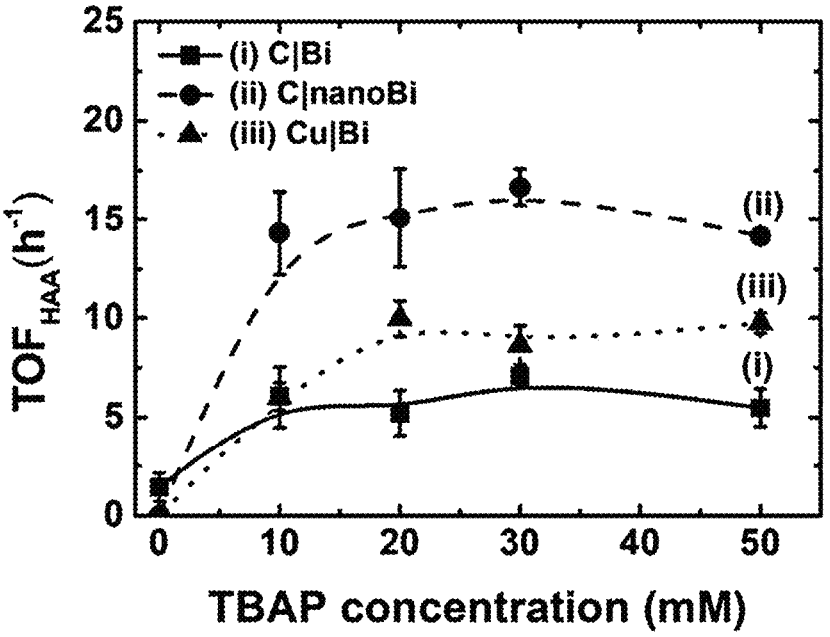
FIG. 6*g* shows the turnover frequencies of different bismuth electrodes towards HAA production ($TOF_{HAA}$) from the 2-h electrolysis at −10 mA/cm$^2$ in the $H_2SO_4$ solution (0.1 M) containing FDCA (2.5 mM) and TBAP of various concentrations.

Further, inductively coupled plasma optical emission spectrometry (ICP-OES) was used to measure contents of bismuth on the C|Bi electrode, the C|nanoBi electrode, and the Cu|Bi electrode. The results show that the contents of bismuth in the C|Bi electrode, the C|nanoBi electrode, and the Cu|Bi electrode are 3.157 μmole/cm$^2$, 1.359 μmole/cm$^2$, and 1.810 μmole/cm$^2$, respectively. The obtained bismuth contents were then used for calculating turnover frequency for the production of HAA ($TOF_{HAA}$). As revealed in FIG. 6*g*, the $TOF_{HAA}$, ranked from highest to lowest, are the C|nanoBi electrode, the Cu|Bi electrode, and the C|Bi electrode.

Figure 6H:
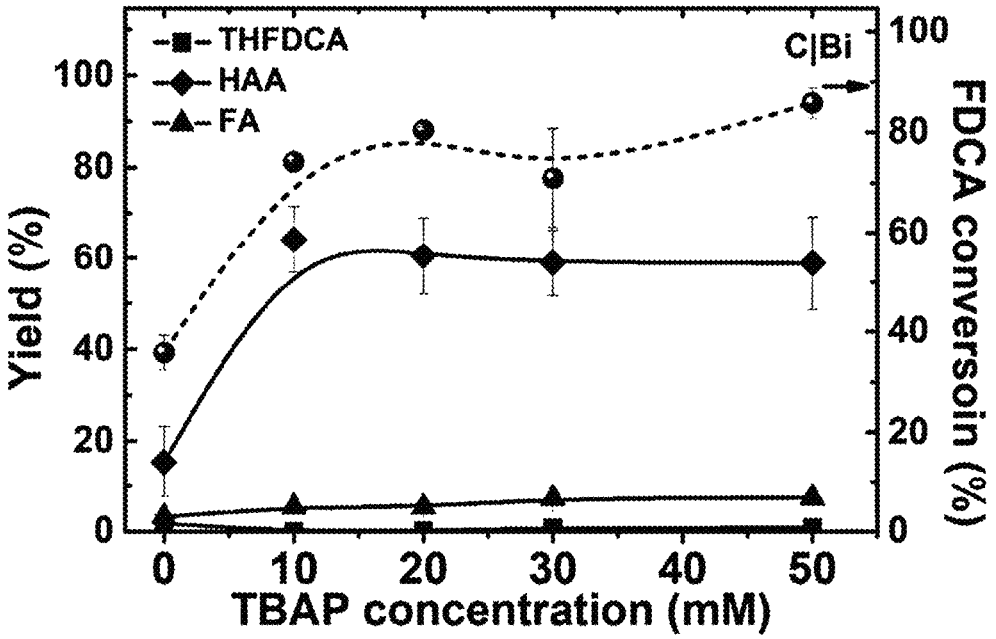
FIG. 6*h* to FIG. 6*j* show the FDCA conversion and the yield of the main products obtained from the 2-h electrolysis at −10 mA/cm$^2$ using different bismuth electrodes
Figure 6I:
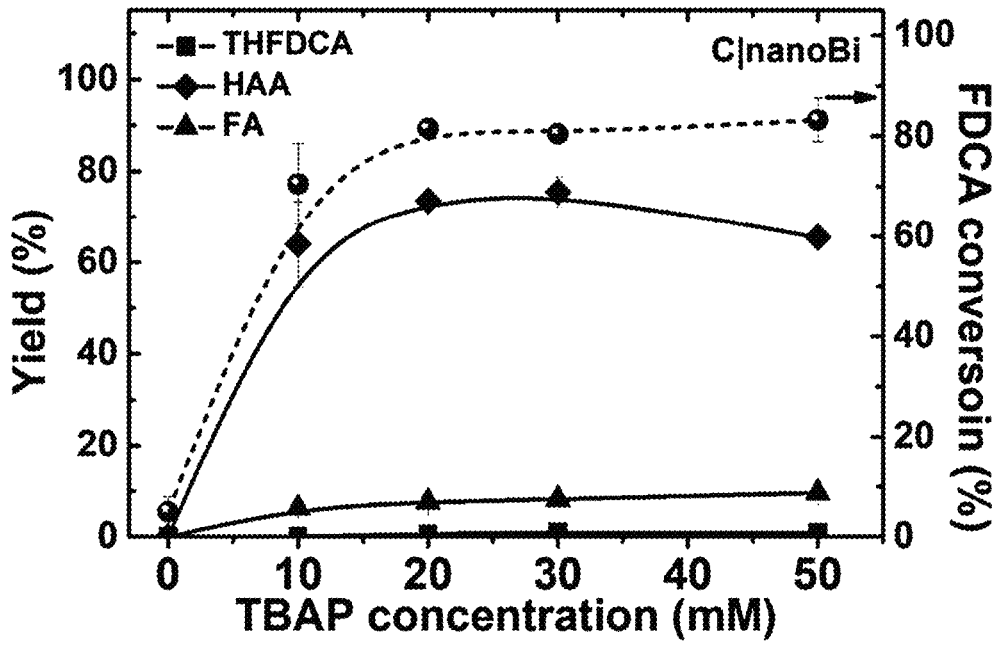
Figure 6J:
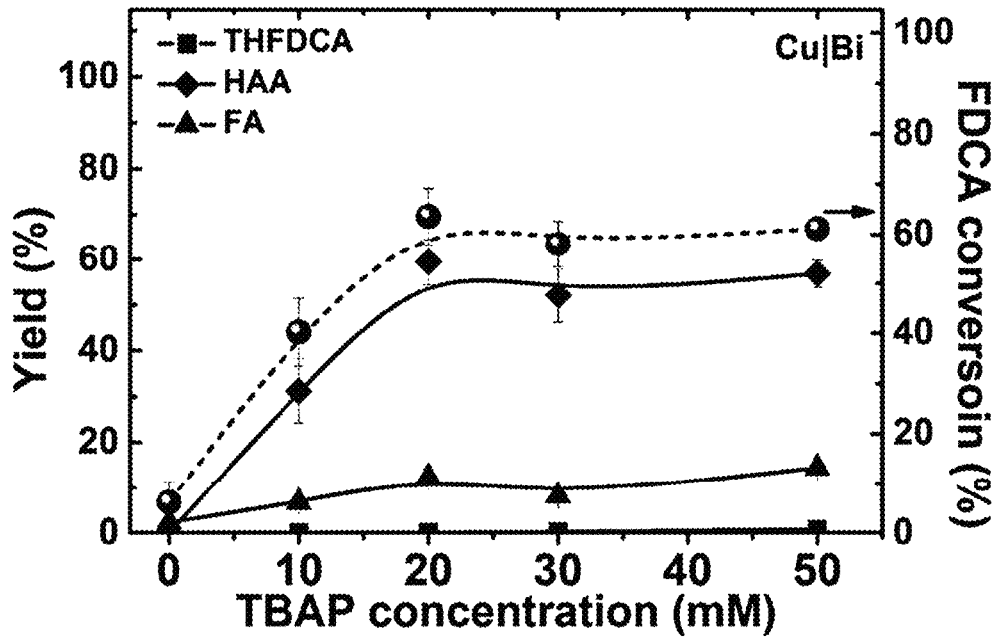

FIG. 6*h*-6*j* show the conversion of FDCA and the yields of main products obtained from the 2-h electrolysis at −10 mA/cm$^2$ in $H_2SO_4$ solution (0.1 M) containing FDCA (2.5 mM) and TBAP of various concentrations using the C|Bi electrode, the C|nanoBi electrode, and the Cu|Bi electrode, respectively. It can be found that the inclusion of TBAP in the electrolyte solution for the electrolysis significantly improved the conversion of FDCA at all the bismuth electrodes. In addition, HAA was generated after the FDCA conversion reached a certain level.

In summary, the HAA faradaic efficiency, HAA selectivity, overall carbon balance, and $TOF_{HAA}$ gradually levelled off when the electrolysis experiments were performed in the presence of sufficient TBAP (≥20 mM). In addition, when the electrolysis experiments were performed in the presence of 30 mM TBAP, the C|nanoBi electrode exhibited the best electrocatalytic performance towards the electrosynthesis of HAA, in terms of $TOF_{HAA}$ (16.67 $h^-$), HAA selectivity (93.86%), HAA Faradaic efficiency (36.27%), HAA yield (75.48%), and the overall carbon balance (97.41%).

Figure 7A:
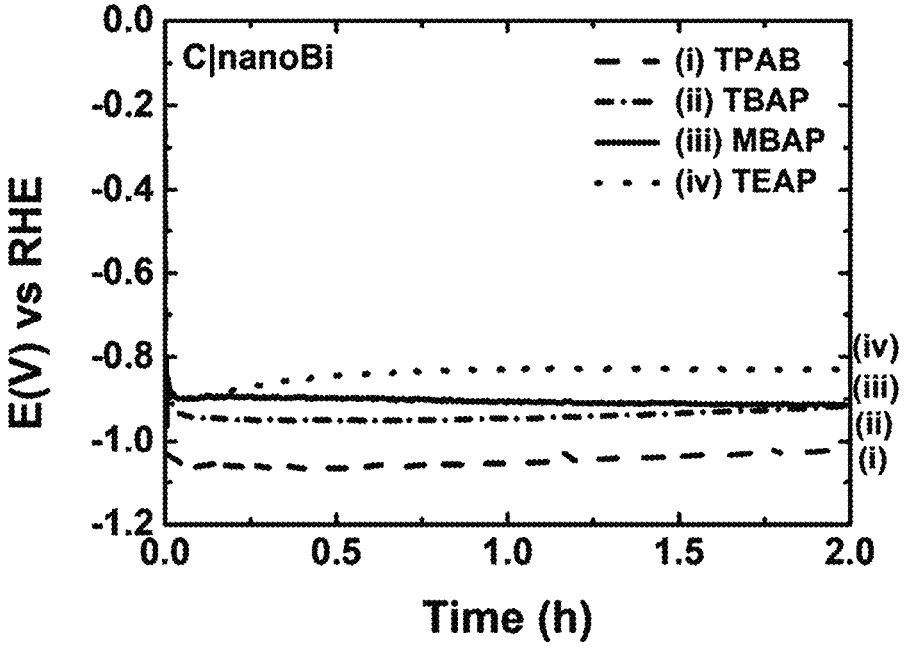
FIG. 7*a* to FIG. 7*e* show the electrocatalytic performance of the C|nanoBi electrode obtained from the 2-h electrolysis at −10 mA/cm$^2$ in the $H_2SO_4$ solution (0.1 M) containing FDCA (2.5 mM) and various QASs (30 mM)
Figure 7B:
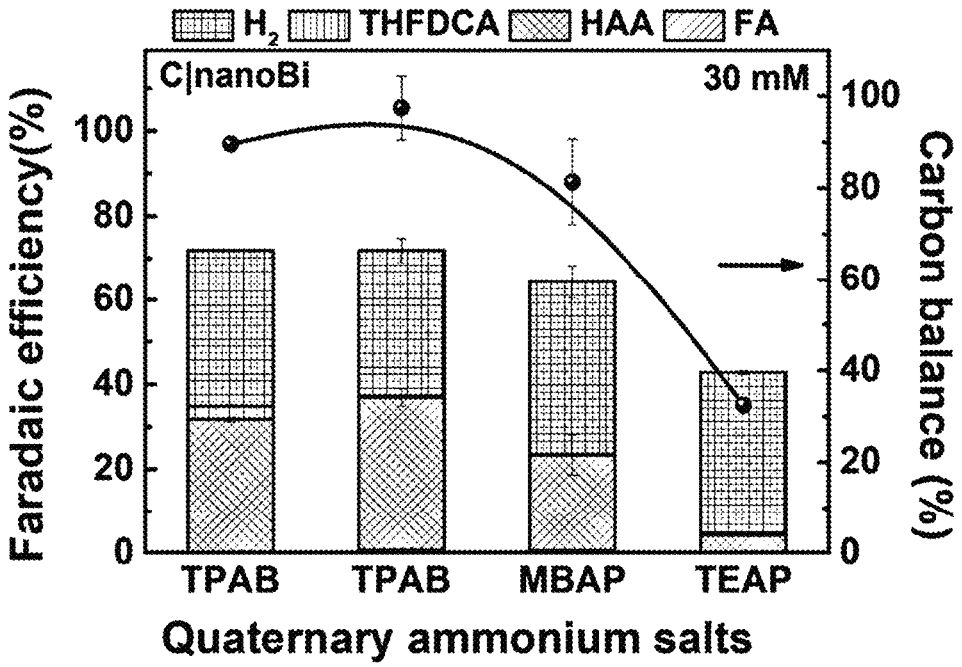
Figure 7C:
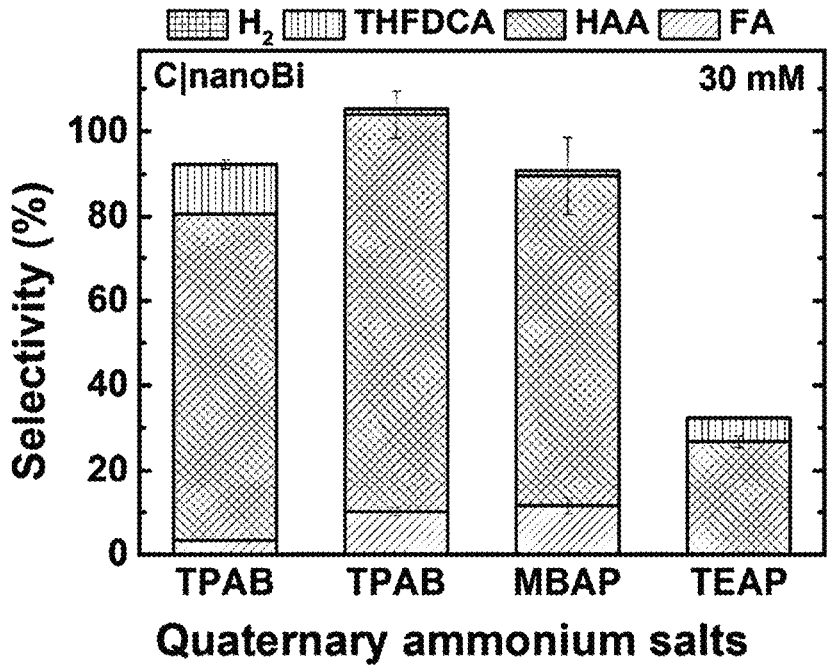
Figure 7D:
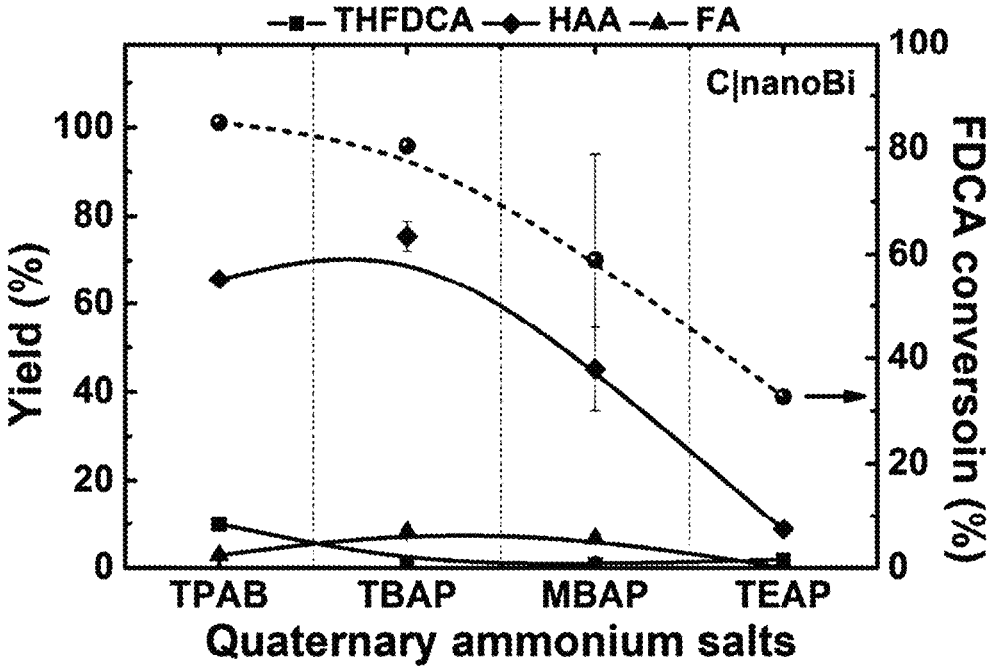
Figure 7E:
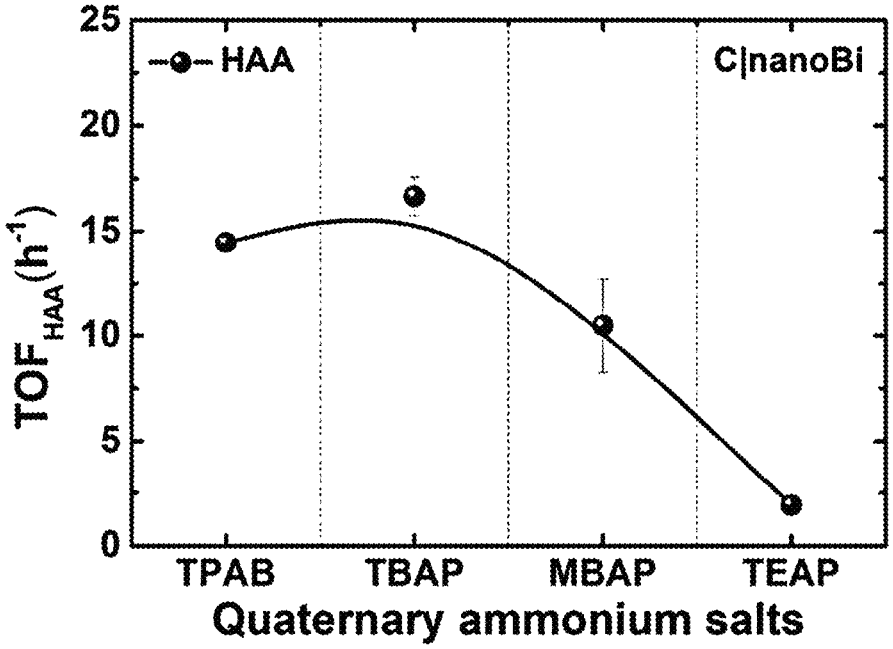

Effects of QAS on the Electrocatalytic Performance of the C|nanoBi Electrode Towards the Electrocatalytic Reduction of FDCA:

The effects of QAS (QAS: TBAP, TPAB, MBAP and TEAB) on the electrocatalytic performance of the C|nanoBi electrode towards the electrocatalytic reduction of FDCA were investigated by a series of 2-h electrolysis experiments at −10 mA/cm$^2$ in the $H_2SO_4$ solution (0.1 M) containing FDCA (2.5 mM) and QAS (30 mM). As revealed in FIG. 7*a*, the potentials for the C|nanoBi electrode to maintain a current density of −10 mA/cm$^2$ in the presence of different QASs were sequentially ranked as TPAB, TBAP, MBAP, and TEAB. As revealed in FIG. 7*b*-7*e*, including TPAB, TBAP, MBAP or TEAB in the electrolyte solution for the electrolysis of FDCA facilitated the ring-opening reactions of FDCA to generate HAA as the main product. In addition, the electrocatalytic performance of the C|nanoBi electrode towards the electrosynthesis of HAA, in terms of HAA faradaic efficiency (FIG. 7*b*), HAA selectivity (FIG. 7*c*), HAA yield and FDCA conversion (FIG. 7*d*), and $TOF_{HAA}$ (FIG. 7*e*). in the presence of different QASs were sequentially ranked as TBAP, TPAB, MBAP, and TEAB. This difference in the electrocatalytic performance of the C|nanoBi electrode could be attributed to the difference in the length of the hydrocarbon chain and type of anion of QAS. Specifically, the electrolysis experiments were performed in the presence of QAS with hydrocarbon chain containing four or five carbons, the C|nanoBi electrode showed enhanced electrocatalytic performance towards the electrosynthesis of HAA via the electrocatalytic reduction of FDCA. In contrast, the C|nanoBi electrode showed poor electrocatalytic performance towards the electrosynthesis of HAA via the electrocatalytic reduction of FDCA when the electrolysis experiments were performed in the presence of QAS with hydrocarbon chain containing less than four carbons or with an asymmetric structure. In addition, halogen anions in the QAS were found to have the negative impacts on the electrocatalytic performance of the C|nanoBi electrode. It is important to note that the noticeable production of AA was only observed when the electrolysis experiments were performed in the presence of 30 mM TBAP (TABLE 4).

TABLE 4

Summary of the products generated from the 2-h electrolysis at −10 mA/cm$^2$ using the C|nanoBi electrode in $H_2SO_4$ solution (0.1M) containing FDCA (2.5 mM) and QAS (30 mM)

| QAS (30 mM) | Product | Amount of product (μmole/cm$^2$) | $FE_{Product}$ (%) | Selectivity (%) | Yield (%) |
|---|---|---|---|---|---|
| TPAB | HCA | 0 | 0 | 0 | 0 |
| | 2-FA | 0.02 | 0 | 0.04 | 0.03 |
| | AA | 0 | 0 | 0 | 0 |
| TBAP | HCA | 0.22 | 0.3 | 0.46 | 0.37 |
| | 2-FA | 0.02 | 0 | 0.04 | 0.03 |
| | AA | 0.07 | 0.07 | 0.14 | 0.11 |
| MBAP | HCA | 0 | 0 | 0 | 0 |
| | 2-FA | 0.02 | 0 | 0.05 | 0.03 |
| | AA | 0 | 0 | 0 | 0 |
| TEAB | HCA | 0 | 0 | 0 | 0 |
| | 2-FA | 0.01 | 0 | 0.04 | 0.01 |
| | AA | 0 | 0 | 0 | 0 |

Figure 8A:
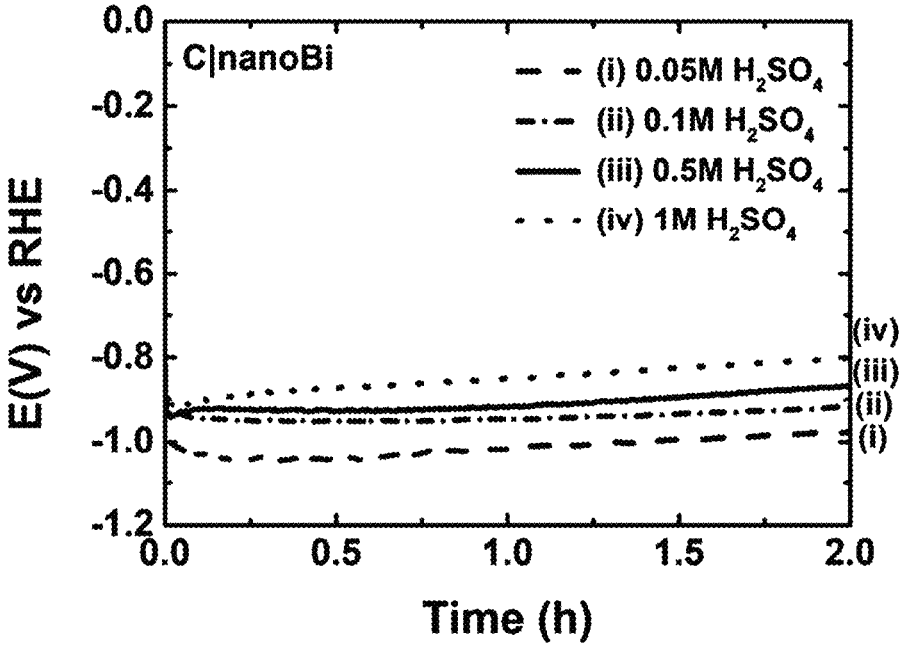
FIG. 8*a* to FIG. 8*e* show the electrocatalytic performance of the C|nanoBi electrode obtained from the 2-h electrolysis at −10 mA/cm$^2$ in the $H_2SO_4$ solution (0.05 M~1 M) containing FDCA (2.5 mM) and TBAP (30 mM)
Figure 8B:
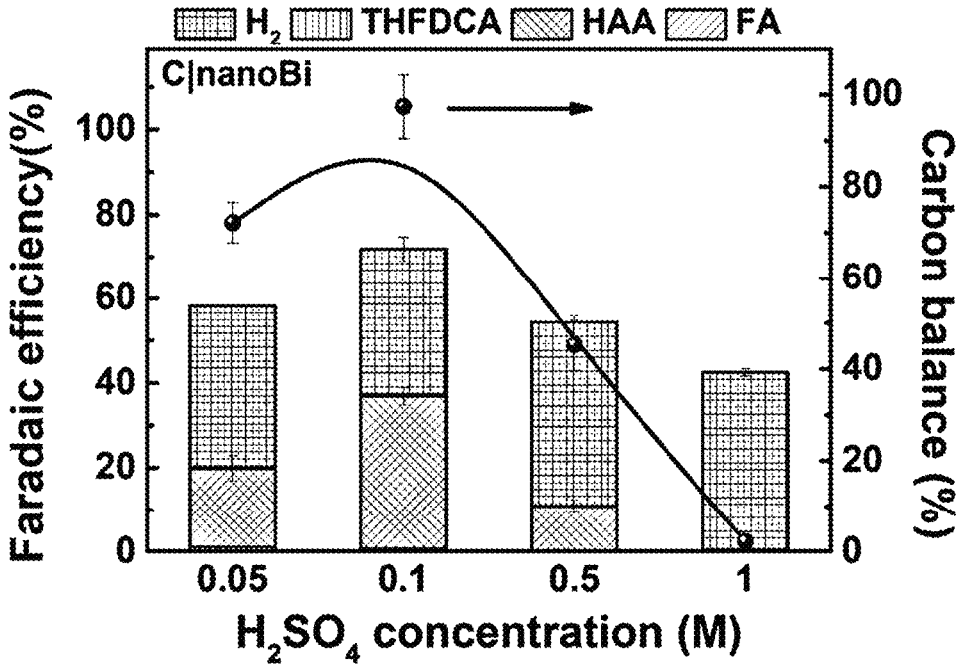
Figure 8C:
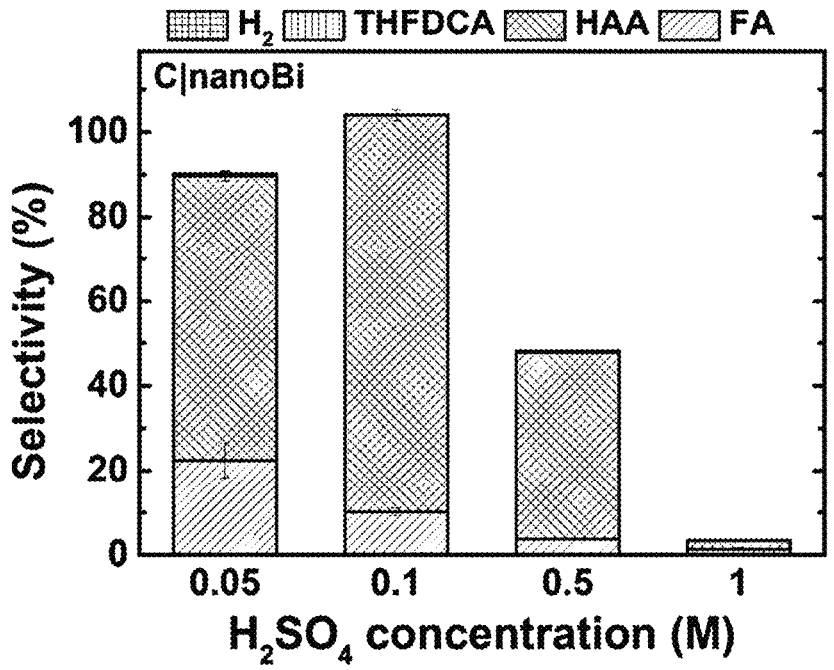
Figure 8D:
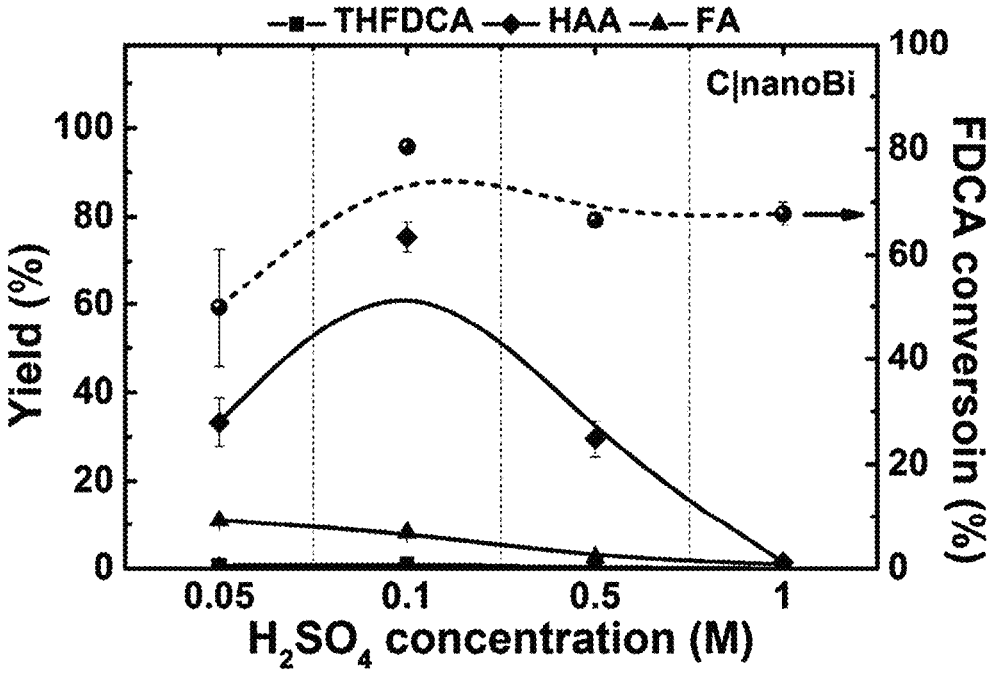
Figure 8E:
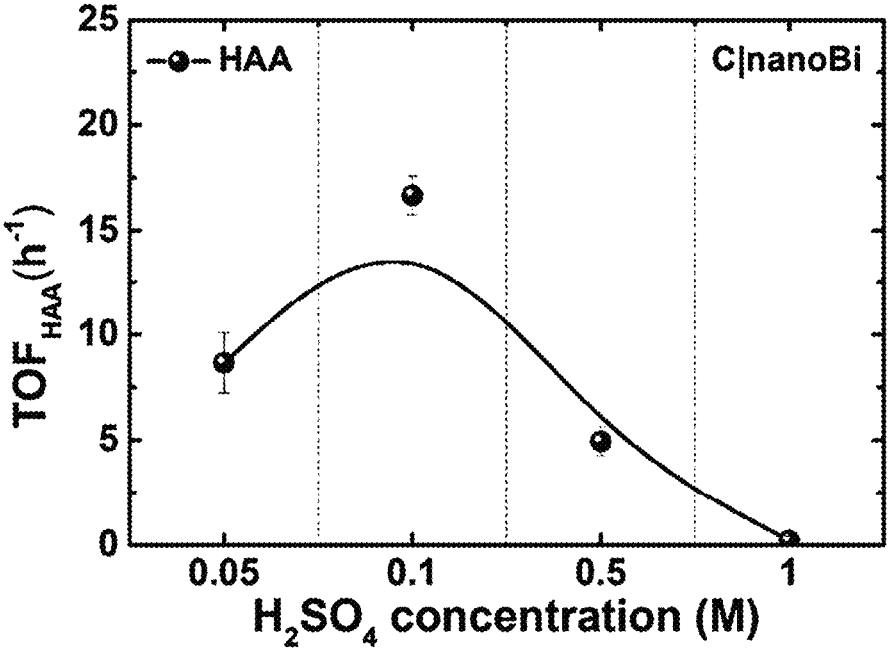

Effects of $H_2SO_4$ Concentration on the Electrocatalytic Performance of the C|nanoBi Electrode Towards the Electrocatalytic Reduction of FDCA:

The effects of $H_2SO_4$ concentration on the electrocatalytic performance of the nanoBi electrode towards the electrocatalytic reduction of FDCA were investigated by a series of 2-h electrolysis experiments at −10 mA/cm$^2$ in the $H_2SO_4$ solution (0.05 M, 0.1 M, 0.5 M, and 1 M) containing FDCA (2.5 mM) and TBAP (30 mM). As revealed in FIG. 8*a*, the potentials for the C|nanoBi electrode to maintain a current density of −10 mA/cm$^2$ increased with decreasing $H_2SO_4$ concentration of electrolyte solution used for the electrolysis. As revealed in FIG. 8*b*-8*e*, the $H_2SO_4$ concentration had a significant effect on the electrocatalytic performance towards the electrocatalytic reduction of FDCA. In addition, the C|nanoBi electrode exhibited the best electrocatalytic performance of towards the electrosynthesis of HAA, in terms of HAA faradaic efficiency (FIG. 8*b*), HAA selectivity (FIG. 8*c*), HAA yield and FDCA conversion (FIG. 8*d*), and $TOF_{HAA}$ (FIG. 8*e*), when the electrolysis experiments were performed in 0.1 M $H_2SO_4$ containing FDCA (2.5 mM) and TBAP (30 mM). It is important to note that when the concentrated $H_2SO_4$ solution (0.5 M or 1 M) was used for electrolysis, FDCA conversion remained at ~70%, but the overall carbon balance decreased, indicating that the other side reactions, involving the consumption of FDCA, became pronounced in the presence of concentrated $H_2SO_4$. In addition, as revealed from TABLE 5, noticeable production of AA was also observed when the electrolysis experiments were performed in the $H_2SO_4$ solution with concentrations of 0.1 M and 0.5 M.

TABLE 5

Summary of the products generated from the 2-h electrolysis at −10 mA/cm$^2$ using the C|nanoBi electrode in the $H_2SO_4$ solution of various concentration (0.05M, 0.1M, 0.5M, and 1M) containing FDCA (2.5 mM) and TBAP (30 mM).

| $H_2SO_4$ solution (M) | Product | Amount of product (μmole/cm$^2$) | $FE_{Product}$ (%) | Selectivity (%) | Yield (%) |
|---|---|---|---|---|---|
| 0.05 | HCA | 0 | 0 | 0 | 0 |
| | 2-FA | 0.02 | 0 | 0.05 | 0.03 |
| | AA | 0 | 0 | 0 | 0 |
| 0.1 | HCA | 0.22 | 0.3 | 0.46 | 0.37 |
| | 2-FA | 0.02 | 0 | 0.04 | 0.03 |
| | AA | 0.07 | 0.07 | 0.14 | 0.11 |
| 0.5 | HCA | 0 | 0 | 0 | 0 |
| | 2-FA | 0.01 | 0 | 0.02 | 0.01 |
| | AA | 0.05 | 0.06 | 0.18 | 0.12 |
| 1.0 | HCA | 0 | 0 | 0 | 0 |
| | 2-FA | 0 | 0 | 0.01 | 0.01 |
| | AA | 0 | 0 | 0 | 0 |

Figure 9:
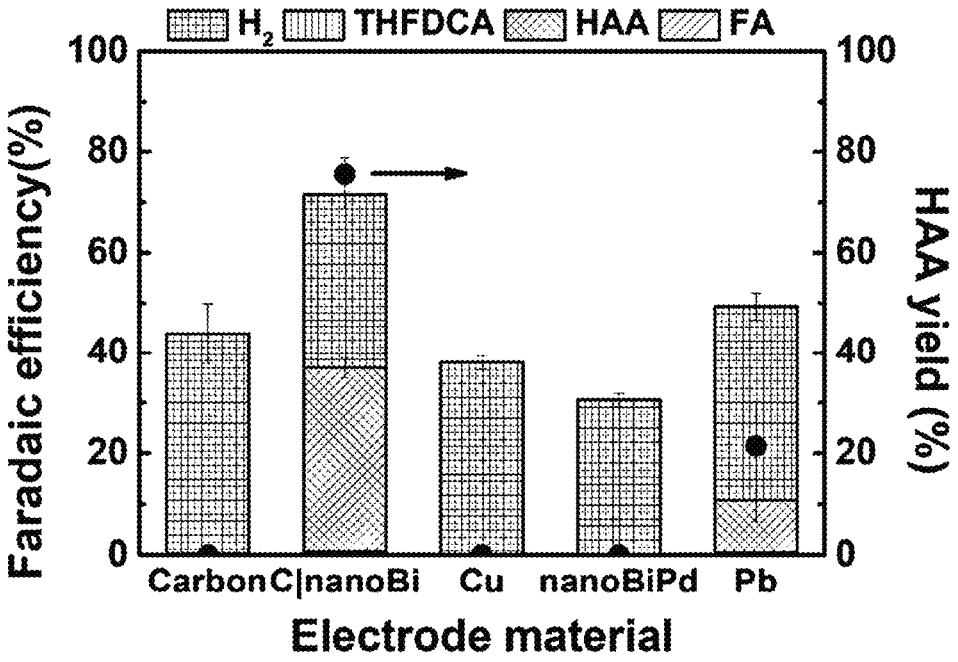
FIG. 9 shows Faradaic efficiencies of the main products and the yield of HAA obtained from the 2-h electrolysis at −10 mA/cm$^2$ using different electrodes in the $H_2SO_4$ solution (0.1 M) containing FDCA (2.5 mM) and TBAP (30 mM).

HAA Yield and Faradaic Efficiency of Products Generated from the 2-h Electrolysis of FDCA Using Different Electrode Materials:

FIG. 9 shows the electrocatalytic performance, in terms of faradaic efficiency and HAA yield, of the various electrode materials obtained from the 2-h electrolysis at a constant current of −10 mA/cm$^2$ in the sulfuric acid solution (0.1 M) containing FDCA (2.5 mM) and TBAP (30 mM). It was found that both lead plate and C|nanoBi electrode exhibited activity towards simultaneous ring-opening and hydrogenation of FDCA and produced HAA as the main products. Specifically, the lead plate showed a HAA faradaic efficiency of 10.19% and a HAA yield of 21.46%, whereas the C|nanoBi electrode exhibited a high HAA faradaic efficiency of 36.27% and a high HAA yield of 75.48%. However, electrolysis experiments using other electrodes, including carbon paper, copper foil, and bismuth-palladium electrodes, mainly generate hydrogen and didn't generate HAA and AA. These findings indicate that the electrode materials also play an important role in determining the product faradaic efficiency, product selectivity, and product yield from the electrocatalytic reduction of FDCA.

Figure 10A:
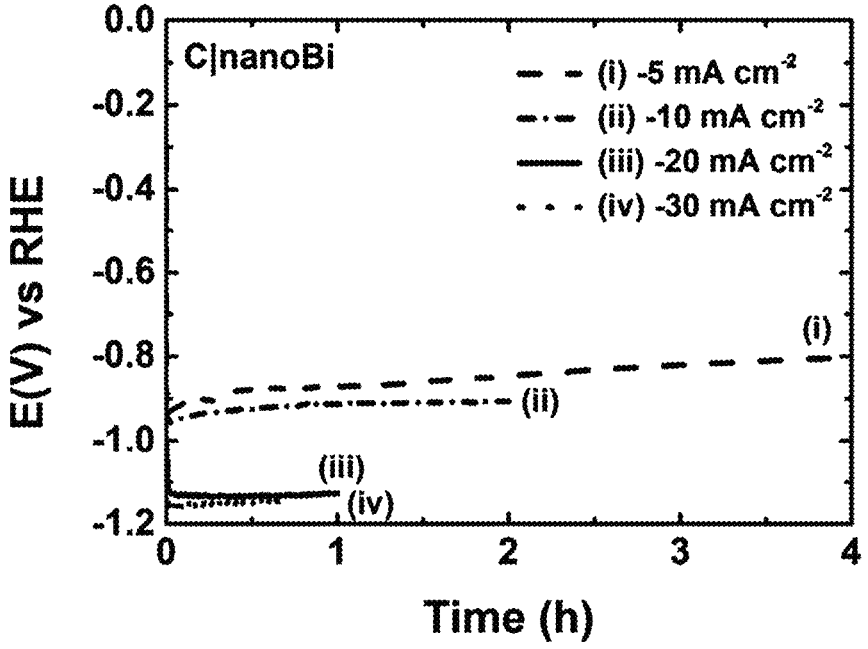
FIG. 10*a* to FIG. 10*e* show the electrocatalytic performance of the C|nanoBi electrode obtained from the 2-h electrolysis at various current densities (−5 mA/cm$^2$~−30 mA/cm$^2$) in the $H_2SO_4$ solution (0.1 M) containing FDCA (2.5 mM) and TBAP (30 mM)
Figure 10B:
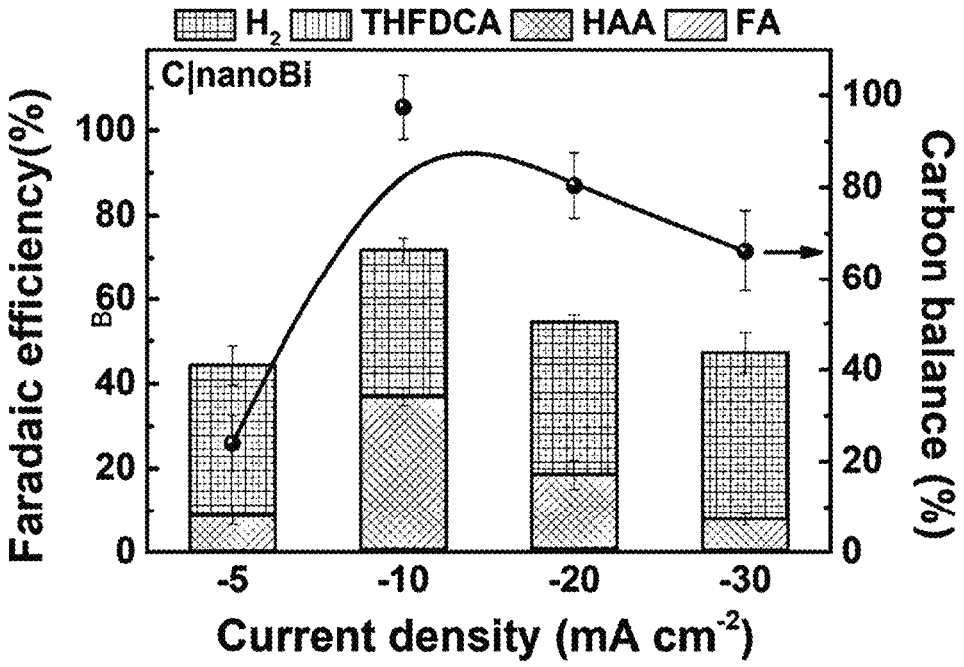
Figure 10C:
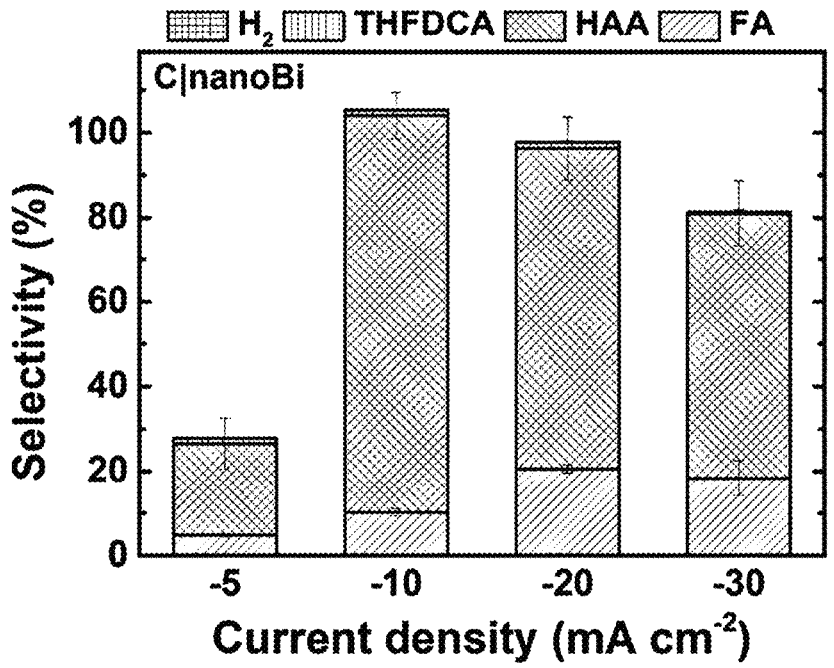
Figure 10D:
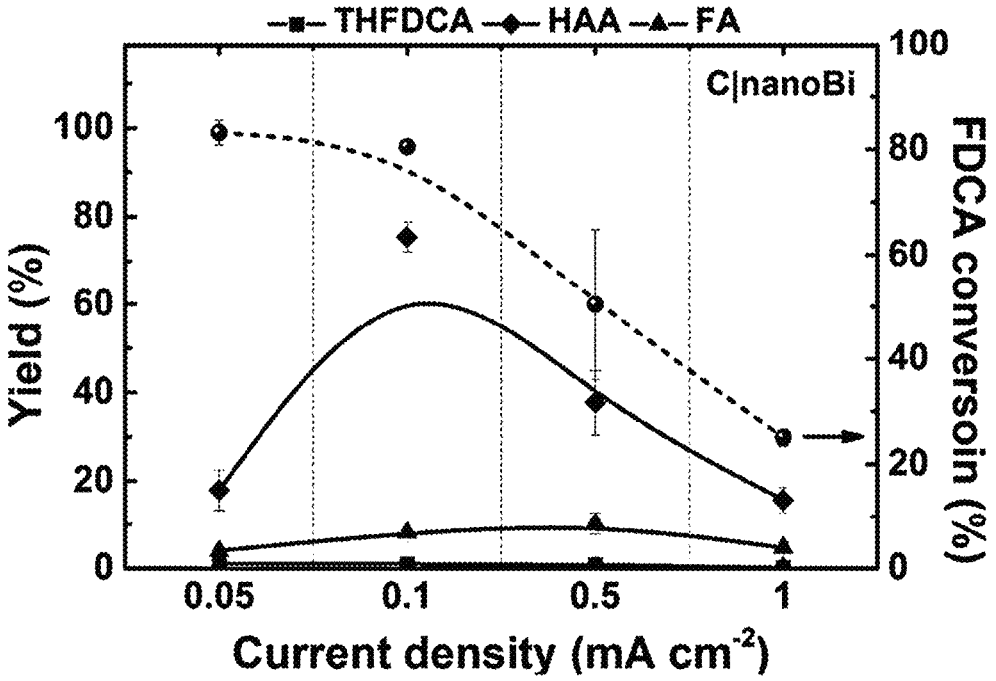
Figure 10E:
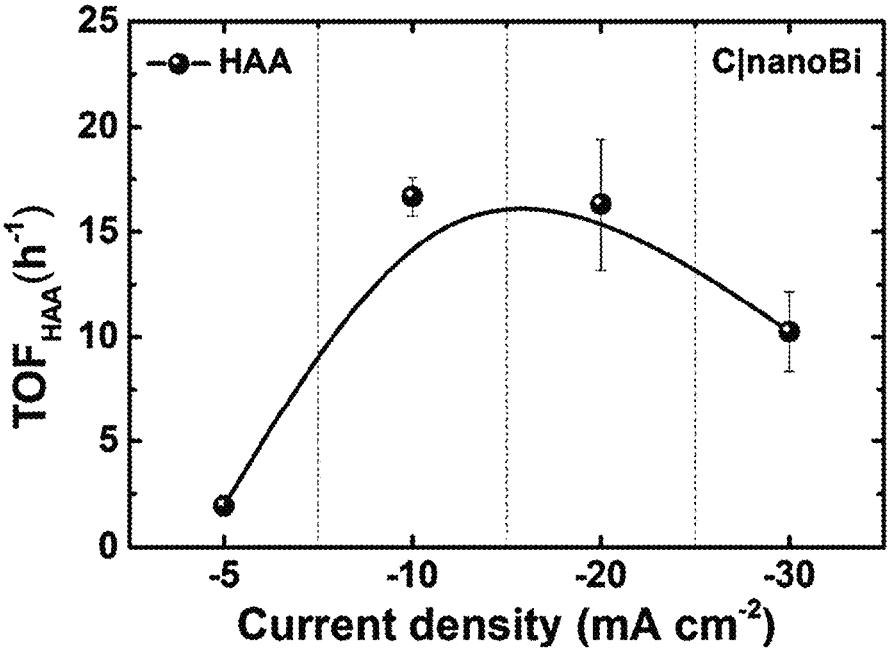

Effects of Applied Current Density for the Electrolysis on the Electrocatalytic Performance of the nanoBi Electrode Towards the Electrocatalytic Reduction of FDCA:

The effects of applied current density for the electrolysis on the electrocatalytic performance of the C|nanoBi electrode towards the electrocatalytic reduction of FDCA were investigated by a series of electrolysis experiments at various applied current densities (−5 mA/cm$^2$, −10 mA/cm$^2$, −20 mA/cm$^2$, −30 mA/cm$^2$) in the $H_2SO_4$ solution (0.1 M) containing FDCA (2.5 mM) and TBAP (30 mM). For the fair comparison, the total charge passage for each electrolysis experiment was fixed at 72 C/cm$^2$. As revealed in FIG. 10*a*, the potentials for the C|nanoBi electrode to maintain the specific applied current density increased with increasing applied current densities used for the electrolysis experiments. As revealed in FIG. 10*b*-10*e*, the applied current used for the electrolysis had a significant effect on the electrocatalytic performance towards the electrocatalytic reduction of FDCA. In addition, the C|nanoBi electrode exhibited the best electrocatalytic performance of towards the electrosynthesis of HAA, in terms of HAA faradaic efficiency (FIG. 10*b*), HAA selectivity (FIG. 10*c*), HAA yield and FDCA conversion (FIG. 10*d*), and $TOF_{HAA}$ (FIG. 10*e*), when the electrolysis experiments were performed at an applied current density of −10 mA/cm$^2$ in 0.1 M $H_2SO_4$ containing FDCA (2.5 mM) and TBAP (30 mM). It is important to note that electrolysis experiments performed at −5 mA/cm$^2$ resulted in the highest FDCA conversion (~83.2%), but lowest overall carbon balance (~24%), indicating that the other side reactions, involving the consumption of FDCA, became pronounced at low applied current density (i.e., −5 mA/cm$^2$). In addition, as revealed from TABLE 6, noticeable production of AA was also observed when the electrolysis experiments were performed at lower applied current densities (i.e., −5 mA/cm$^2$, and −10 mA/cm$^2$). Nevertheless, when the electrolysis experiments were performed at high applied current densities (i.e., −20 mA/cm$^2$ and −30 mA/cm$^2$), the hydrogen evolution reaction became significant, resulting in lower FDCA conversion, lower HAA faradaic efficiency, lower HAA selectivity, and lower $TOF_{HAA}$.

TABLE 6

Summary of the products generated from the 2-h electrolysis at various applied current densities (−5 mA/cm$^2$, −10 mA/cm$^2$, −20 mA/cm$^2$, −30 mA/cm$^2$) using the C|nanoBi electrode in the $H_2SO_4$ solution (0.1M) containing FDCA (2.5 mM) and TBAP (30 mM). The total charge passage for each electrolysis experiment was fixed at 72 C/cm$^2$.

| Current density (mA/cm$^2$) | Product | Amount of product (μmole/cm$^2$) | $FE_{Product}$ (%) | Selectivity (%) | Yield (%) |
|---|---|---|---|---|---|
| −5 | HCA | 0 | 0 | 0 | 0 |
| | 2-FA | 0.03 | 0 | 0.06 | 0.05 |
| | AA | 0.09 | 0.09 | 0.18 | 0.15 |
| −10 | HCA | 0.22 | 0.3 | 0.46 | 0.22 |
| | 2-FA | 0.02 | 0 | 0.04 | 0.02 |
| | AA | 0.07 | 0.07 | 0.14 | 0.07 |
| −20 | HCA | 0 | 0 | 0 | 0 |
| | 2-FA | 0.02 | 0 | 0.07 | 0.02 |
| | AA | 0 | 0 | 0 | 0 |
| −30 | HCA | 0 | 0 | 0 | 0 |
| | 2-FA | 0.02 | 0 | 0.12 | 0.02 |
| | AA | 0 | 0 | 0 | 0 |

Example 1

Method of Preparing 2-Hydroxyadipic Acid and Adipic Acid:

2.5 mM of 2,5-furandicarboxylic acid was electrolyzed in a 0.1 M of sulfuric acid solution containing 30 mM TBAP by using a bismuth nanosheets-modified carbon electrode at a constant current of −10 mA/cm$^2$ for 2 hours.

Example 2

Method of Preparing 2-Hydroxyadipic Acid:

2.5 mM of 2,5-furandicarboxylic acid was electrolyzed in a 0.1 M of sulfuric acid solution by using an electroplated bismuth thin film-modified carbon electrode at a constant current of −10 mA/cm$^2$ for 2 hours.

Example 3

Method of Preparing 2-Hydroxyadipic Acid and Adipic Acid:

2.5 mM of 2,5-furandicarboxylic acid was electrolyzed in a 0.05 M of sulfuric acid solution containing 30 mM TBAP by using a bismuth nanosheets-modified carbon electrode at a constant current of −10 mA/cm$^2$ for 2 hours.

Example 4

Method of Preparing 2-Hydroxyadipic Acid:

2.5 mM of 2,5-furandicarboxylic acid was electrolyzed in a 0.1 M of sulfuric acid solution containing 30 mM of TPAB by using a bismuth nanosheets-modified carbon electrode at a constant current of −10 mA/cm$^2$ for 2 hours.

Example 5

Method of preparing 2-Hydroxyadipic Acid and Adipic Acid:

2.5 mM of 2,5-furandicarboxylic acid was electrolyzed in a 0.1 M of sulfuric acid solution containing a 30 mM of TBAP by using a bismuth nanosheets-modified carbon electrode at a constant current of −5 mA/cm$^2$ for 2 hours.

In summary, using FDCA as the reactant, a bismuth metal electrode with specific quaternary ammonium salts, or a bismuth metal electrode with a particular morphology without the addition of quaternary ammonium salts, enables simultaneous ring-opening and hydrogenation of 2,5-furandicarboxylic acid. This process does not require high temperatures, high pressure, precious metal catalysts, or other chemical agents. Additionally, using water as the hydrogen source eliminates the costs and energy consumption associated with hydrogen production, storage, and transport. It also avoids competition with green hydrogen production, making this method highly applicable in green, low-carbon chemical industrial production.

While the preferred embodiments of the present disclosure have been described above, it will be recognized and understood that various changes and modifications can be made, and the appended claims are intended to cover all such changes and modifications which may fall within the spirit and scope of the present disclosure.

What is claimed is:

1. A method of preparing 2-hydroxyadipic acid and adipic acid, comprising the step of: electrolyzing 2 to 3 mM of 2,5-furandicarboxylic acid using a metal electrode at a constant current in a sulfuric acid solution containing a quaternary ammonium salt, wherein the metal electrode is a bismuth electrode or a lead electrode, and the quaternary ammonium salt is represented by formula (I):

(I)

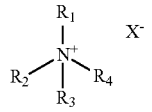

wherein $R_1$ to $R_4$ are independently a $C_{2-5}$ hydrocarbon group, and $X^-$ is $ClO_4^-$, $H_2PO_4^-$, or $Br^-$.

2. The method of preparing 2-hydroxyadipic acid and adipic acid as claimed in claim 1, wherein the step of electrolyzing 2 to 3 mM of 2,5-furandicarboxylic acid is conducted at ambient temperature and pressure.

3. The method of preparing 2-hydroxyadipic acid and adipic acid as claimed in claim 1, wherein the quaternary ammonium salt is selected from the group consisting of tetrabutylammonium phosphate, tetrapentylammonium bromide, tetraethylammonium perchlorate, and tributylmethylammonium phosphate.

4. The method of preparing 2-hydroxyadipic acid and adipic acid as claimed in claim 1, wherein the bismuth electrode is selected from the group consisting of an electroplated bismuth thin film-modified carbon electrode, a bismuth nanosheets-modified carbon electrode, and a bismuth-modified copper electrode prepared by electroless deposition.

5. The method of preparing 2-hydroxyadipic acid and adipic acid as claimed in claim 1, wherein a current density of the constant current ranges from −5 mA/cm$^2$ to −30 mA/cm$^2$.

6. The method of preparing 2-hydroxyadipic acid and adipic acid as claimed in claim 1, wherein a concentration of the quaternary ammonium salt ranges from 10 mM to 50 mM.

7. The method of preparing 2-hydroxyadipic acid and adipic acid as claimed in claim 1, wherein a concentration of the sulfuric acid solution ranges from 0.05 M to 1 M.

* * * * *